US009915110B2

(12) United States Patent
Berrier et al.

(10) Patent No.: US 9,915,110 B2
(45) Date of Patent: Mar. 13, 2018

(54) POWER TONGS TESTING SYSTEM

(71) Applicant: A BETTER FABRICATION, LLC, Weatherford, TX (US)

(72) Inventors: Russell Lee Berrier, Weatherford, TX (US); Dearl Lynn Berrier, Weatherford, TX (US)

( * ) Notice: Subject to any disclaimer, the term of this patent is extended or adjusted under 35 U.S.C. 154(b) by 0 days.

(21) Appl. No.: 15/109,443

(22) PCT Filed: Jan. 23, 2015

(86) PCT No.: PCT/US2015/012549

§ 371 (c)(1),
(2) Date: Jul. 1, 2016

(87) PCT Pub. No.: WO2015/112778

PCT Pub. Date: Jul. 30, 2015

(65) Prior Publication Data

US 2016/0333650 A1 Nov. 17, 2016

Related U.S. Application Data

(60) Provisional application No. 61/930,460, filed on Jan. 22, 2014.

(51) Int. Cl.
*B25B 23/14* (2006.01)
*E21B 19/16* (2006.01)
*E21B 17/042* (2006.01)

(52) U.S. Cl.
CPC ..... *E21B 19/166* (2013.01); *E21B 17/042* (2013.01); *E21B 19/164* (2013.01); *E21B 19/165* (2013.01)

(58) Field of Classification Search
CPC .... E21B 19/166; E21B 17/042; E21B 19/164; E21B 19/165

(Continued)

(56) References Cited

U.S. PATENT DOCUMENTS 4,199,032 A 4/1980 Weiner et al.
7,891,418 B2 2/2011 Begnaud (Continued)

FOREIGN PATENT DOCUMENTS

EP 2232002 B1 1/2012

OTHER PUBLICATIONS

PCTUS2015012549wosa000030enKR: Written Opinion of the International Searching Authority for PCT/US2015/125049—Korean IPO—dated May 15, 2015.

(Continued)

*Primary Examiner* — Max Noori

(74) *Attorney, Agent, or Firm* — Guy V. Manning

(57) ABSTRACT

A test stand, for testing several parameters of power tongs used to make and break drill and casing pipe segments, includes a base having a vertical, rotating shaft bearing along its length one or more disk brakes for stopping rotation of the shaft induced by tongs. In a particular embodiment, a vertical mast on the base supports a rotatable gantry which can lift and move power tongs into place above the test stand. Sensors detect several parameters which determine tong performance. Measurements of torque, RPM, temperature, pressure and speed are contrasted to standards for power tongs of like size and capacity and feedback as to the tongs' ability to make and break drill and pipe joints is provided. In another embodiment, a derrick sits atop the base and supports a second, inverted test stand for testing integrated power tongs.

19 Claims, 28 Drawing Sheets

(58) Field of Classification Search
USPC ..... 73/862, 25, 862.25
See application file for complete search history.

(56) References Cited

U.S. PATENT DOCUMENTS

| | | | | |
|---|---|---|---|---|
| 8,949,416 | B1 * | 2/2015 | Barnes | G06F 15/17306 370/229 |
| 2007/0074606 | A1 * | 4/2007 | Halse | E21B 19/164 81/57.16 |
| 2009/0126536 | A1 * | 5/2009 | Begnaud | E21B 19/165 81/57.34 |
| 2011/0219916 | A1 * | 9/2011 | Haughom | E21B 19/164 81/57.16 |
| 2012/0323500 | A1 | 12/2012 | Prefontaine | |
| 2013/0255446 | A1 | 10/2013 | Taggart | |
| 2013/0319674 | A1 | 12/2013 | Smith | |
| 2015/0107850 | A1 * | 4/2015 | Mosing | E21B 19/165 166/377 |
| 2015/0275597 | A1 * | 10/2015 | Thibodeaux | E21B 19/164 81/57.11 |

OTHER PUBLICATIONS

PCTUS2015012549isre000029enKR: International Search Report (of the International Searching Authority) for PCT/US2015/125049—Korean IPO—dated May 15, 2015.

* cited by examiner 150
227
228
152
227
236
235
238
232
160
226
234
249
243
245
246
247
223
245
240
245
223
230
243
222
221
160
233
225
101

457

455

POWER TONGS TESTING SYSTEM

BACKGROUND OF THE INVENTION

1. Field of the Invention

This invention relates generally to oil and gas drilling equipment, and particularly to tongs or other equipment used on drilling rigs for coupling and decoupling stands of drill pipe. More particularly, this invention relates to a test stand for testing torque applied by tongs to drill stem.

2. Description of Related Art

In oil and gas exploration and production, a drilling rig is positioned over a well bore site for drilling or reworking a well. During rig operations, a derrick sitting atop the drilling rig's platform repeatedly lifts stands, or segments, of pipe, into a vertical position above the well bore, where each stand is successively joined with the one below which already is inserted into the well bore. Once fully made up, the stand is lowered into the hole, whereupon another stand is lifted and coupled thereto. Within the derrick platform floor, a rotary table grasps in its jaws the upper end of the top segment of pipe already in the hole pending joining to it another stand. The derrick thus chains together stands of pipe for insertion into the well bore, either to serve as casing to line the bore hole, drill stem to turn drill bits at the bottom of the hole to increase bore depth, or production well pipe for extracting oil and/or gas from a producing well.

Typical well pipe joints comprise nominally thirty (30 ft.) foot segments of steel tube having an outside diameter of between four and one-half (4.5 in.) to fifteen (15 in.) inches or more, each with male (pin) and female (box) threads on opposite ends thereof. When two pipe segments are being joined, a derrick hand stabs the pin of the upper pipe segment into the box of the lower pipe segment, whereupon other derrick hands spin the upper pipe segment to tighten the threads together. This process seldom if ever tightens the threads enough. To do so, derrick hands commonly employ powered tools known as tongs to spin the upper pipe further until a specific torque is reached. Commonly, a second, lower tong grasps the lower pipe segment to hold it and prevent it from rotating while the upper tong tightens the joint.

Not surprisingly, well pipe, along with the joints between segments thereof, endure significant torque, compression and tension pressures during operation. Poorly mated pipe joints can flex, wobble and break under such pressures. A need exists for means to assure that pipe joints are tightened to specified torques to prevent such mishaps.

Power tongs engage and turn pipe to predetermined torque settings within the machinery itself. Unlike with smaller pipe and manual tongs, a derrick hand must rely upon the power tongs to exert sufficient torque to join the pipe segments together. If a power tong unit cannot produce the required torque and rotate the upper pipe sufficiently, the derrick hand has no means for determining whether or not the make-up was performed properly. A need exists for means for testing torque output of power tongs to assure that they meet standards prior to being used on drilling rigs.

SUMMARY OF THE INVENTION

The invention comprises a test stand having a planar platform supporting a vertical mast which includes a horizontal, rotatable crane capable of lifting and holding the weight of power tongs. A block and tackle on the crane attaches to a yoke typically included with such power tongs. Further supported by the platform is a test stand having a bottom chamber. A circular plate spans the bottom chamber and is held to an annular flange of like diameter by perimeter bolts extending through slotted bolt holes in the circular plate.

The testing device comprises a vertical shaft supported by the plate and capable of rotating in response to impetus from the tongs. The shaft includes a mandrel at its upper extreme which the power tongs surround and grasp for providing such impetus. Along the vertical length of the shaft below the mandrel, one or more circular rotor disks are coupled to and rotate with the shaft. Stationary pneumatic calipers coupled to the base engage the rotors and, in response to testing sequence instructions, clamp down onto the rotors to retard and stop their rotation and thereby rotation of the mandrel being turned by the tongs. The number of calipers and rotors is selected to meet or exceed the power capabilities of the tongs, and measurements are taken during testing to determine torque necessary to stop the tongs, thereby determining the strength of the tongs.

In another particular embodiment, the mast and crane are replaced by a derrick which supports a second tong test stand inverted below the top floor of the derrick with its mandrel extending downward toward the first test stand. An integrated tong having both drive and back-up jaws grasps the inverted mandrel and the upright mandrel respectively, the latter being pinned to remain stationary during testing of the upper drive tong using the inverted test stand. The integrated tong is maneuvered into place using separate equipment, such as a fork lift or the drilling rig's bridge crane and bridle.

Also supported on the platform is a monitoring stand enclosing a touch screen operator interface, sensor connections to the sensors arrayed around the vertical shaft, and a ruggidized personal computer running software adapted to monitor torque in relation to rpms, temperature, pressure, time and other parameters, and to contrast them to standard criteria for certification of the power tongs being tested.

BRIEF DESCRIPTION OF THE DRAWINGS

The novel features believed characteristic of the present invention may be set forth in appended claims. The invention itself, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
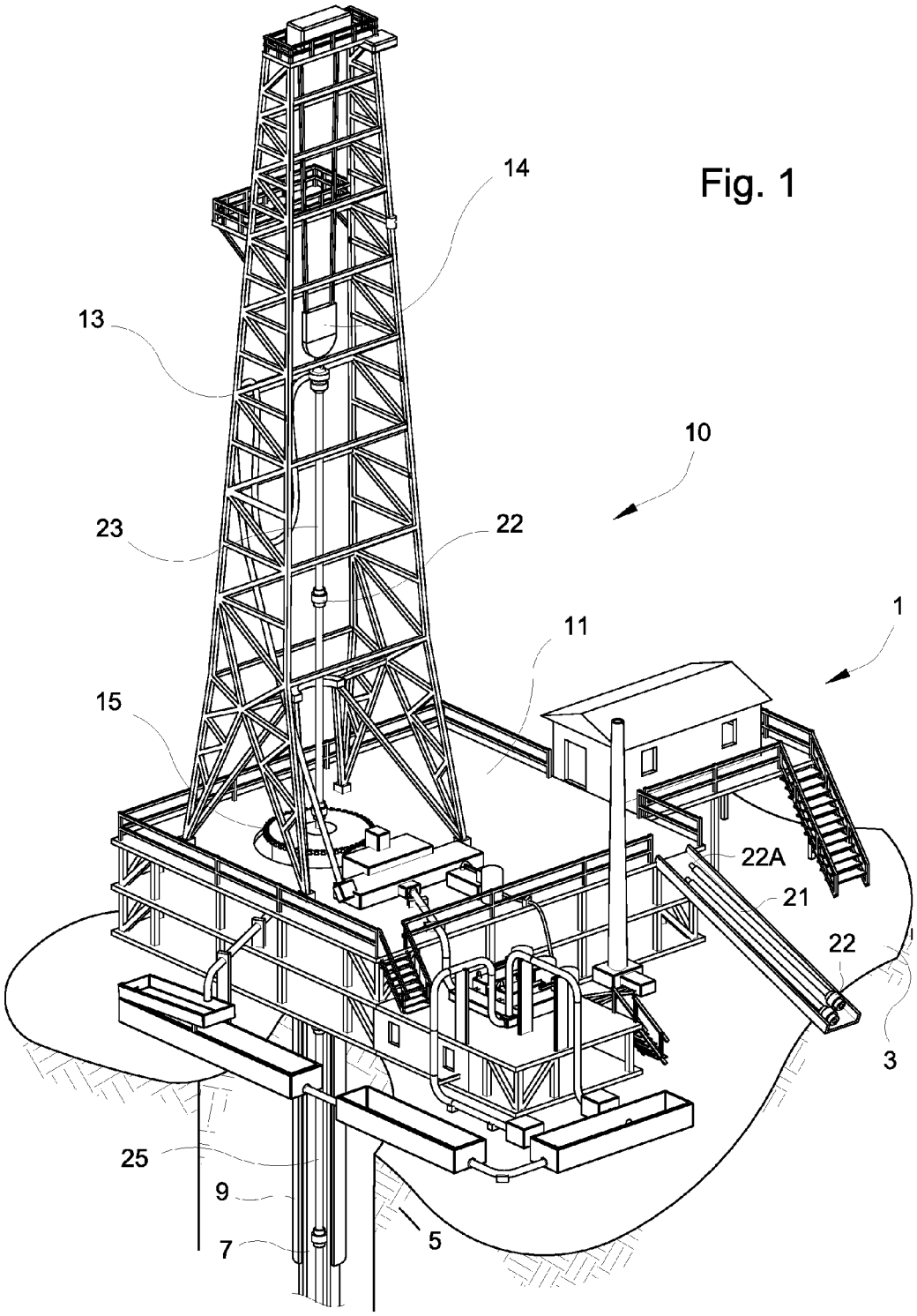
FIG. 1 shows the context of drilling rig operations and components of a drilling derrick.
Figure 2:
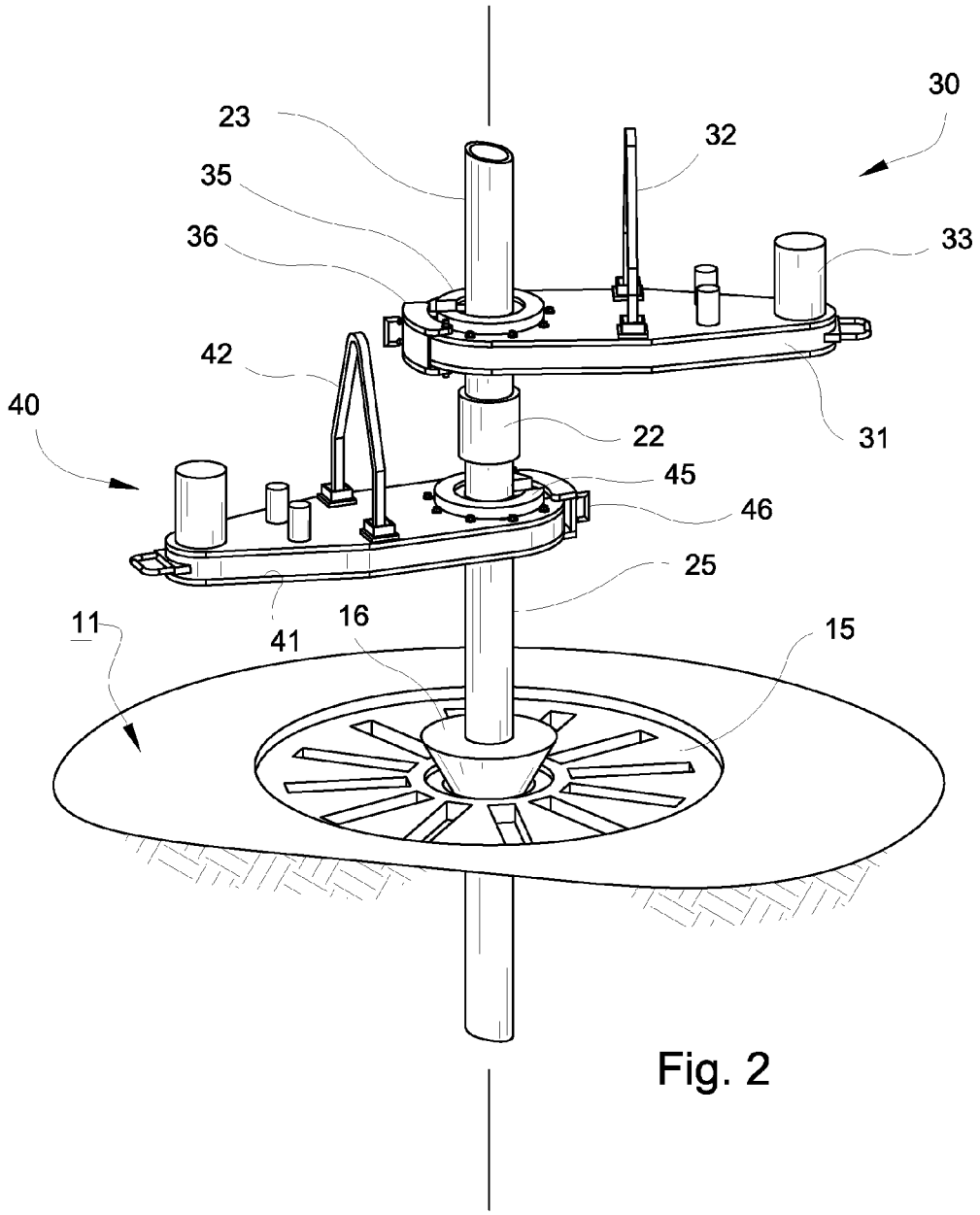
FIG. 2 details general configuration and use of power tongs on the drilling rig of FIG. 1.

Referring now to the figures, and particularly to FIGS. 1-2, drilling rig 10 is shown situated on drill site 1 and adapted to drill well 5 extending downward into the earth beneath grade 3 of drill site 1. Drilling rig 10 may be an oil well, gas well, water well, or one of any number of other drilling rigs intended to exploit underground, primarily fluid mineral resources from drill site 1. Though drilling rig 10 is shown installed directly atop grade 3, one having ordinary skill in the art will recognize that drilling rig 10 could be an offshore platform drilling for mineral resources from beneath the ocean, whereupon grade 3 would comprise the ocean floor, and rig platform 11 would be elevated above the ocean water level by rig platform legs (not shown).

Supported atop working platform 11, drilling rig 10 includes derrick 13 within which traveling block 14 articulates between an upper position near the top of derrick 13 and a lower position near platform 11. Traveling block 14 raises and lowers pipe stands 23 made up of a plurality of, usually three, thirty-foot joints of pipe coupled together end-to-end. Each pipe joint includes a coupling, or box 22 disposed on its upper end, the lower end, or pin 22A, being threaded to match box 22's threads. Each pipe stand 23 held in derrick 13 in turn is coupled to down-hole pipe 25 and lowered into well 5 until it protrudes a short distance above platform 11, as shown in FIG. 2. Another stand 23 then is lifted into place within derrick 13 by traveling block 14 and the process is repeated. In such manner, literally miles of pipe 20 can be installed into well 5. Removal of pipe 20 proceeds in reverse order, with stands 23 unscrewed from down-hole pipe 25 until a desired amount of pipe 20 has been removed.

As best seen in FIG. 2, the top segment of down-hole pipe 25 protrudes a select distance above platform 11 through rotary table 15 and usually is held in place by wedge shaped chocks, or slips 16, adapted to prevent pipe 20 from falling through rotary table 15 and into well 5. New pipe stand 23 is maneuvered into alignment with upper box 22 of down-hole pipe 25, and preparations are made to stab the pin (not shown; threaded lower end) of stand 23 into box 22. Rig hands (not shown) typically then initially turn stand 23 by hand, with the kelly (not shown; attached to the traveling block) or with a spinning chain (not shown). Power tongs 30 are needed, however, to provide the final tightening to a specified torque for pipe 20. Often, two power tongs are employed. Lower power tongs 40 grasp the upper end of pipe 25 and hold it so it cannot rotate, while upper power tongs 30 grasp stand 23 and rotate it to screw the pin of stand 23 into box 22 of pipe 25. Slips 16 then are removed and stand 23 is lowered into well 5, and the whole process is repeated.

As the above process demonstrates, power tongs 30, 40, and particularly rotating power tongs 30, must be able to produce sufficient torque to tighten pin 22A of stand 23 into box 22. Power tongs 30 periodically must be tested and certified that they are capable of doing so, as determined by contrasting test data to certification standards for the particular power tong 30 being tested. The present invention provides means for conducting such testing and certifying.

Tong Test Stand

Figure 3:
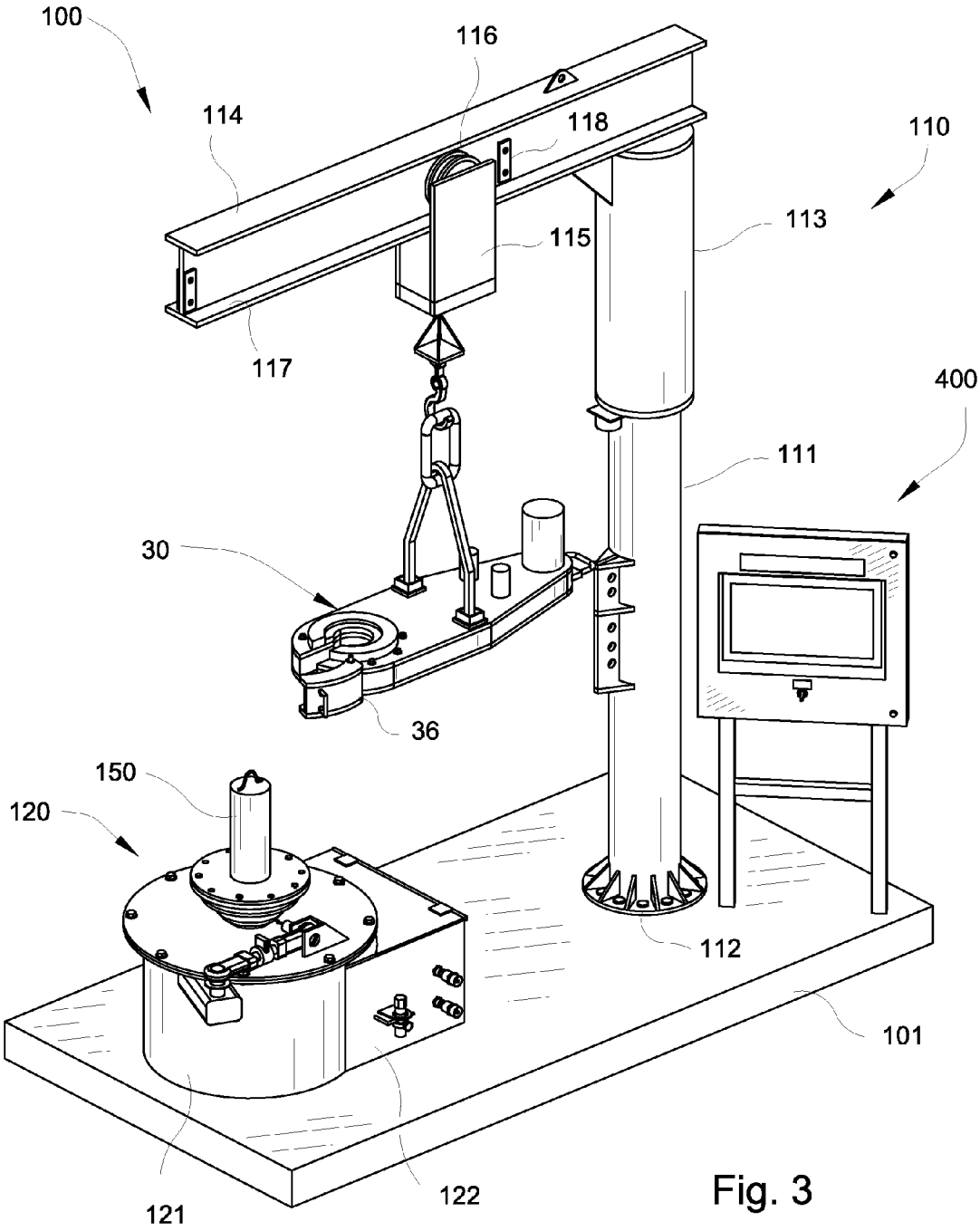
FIGS. 3-4 depict a particular embodiment of the tong testing system of the present invention.
Figure 4:
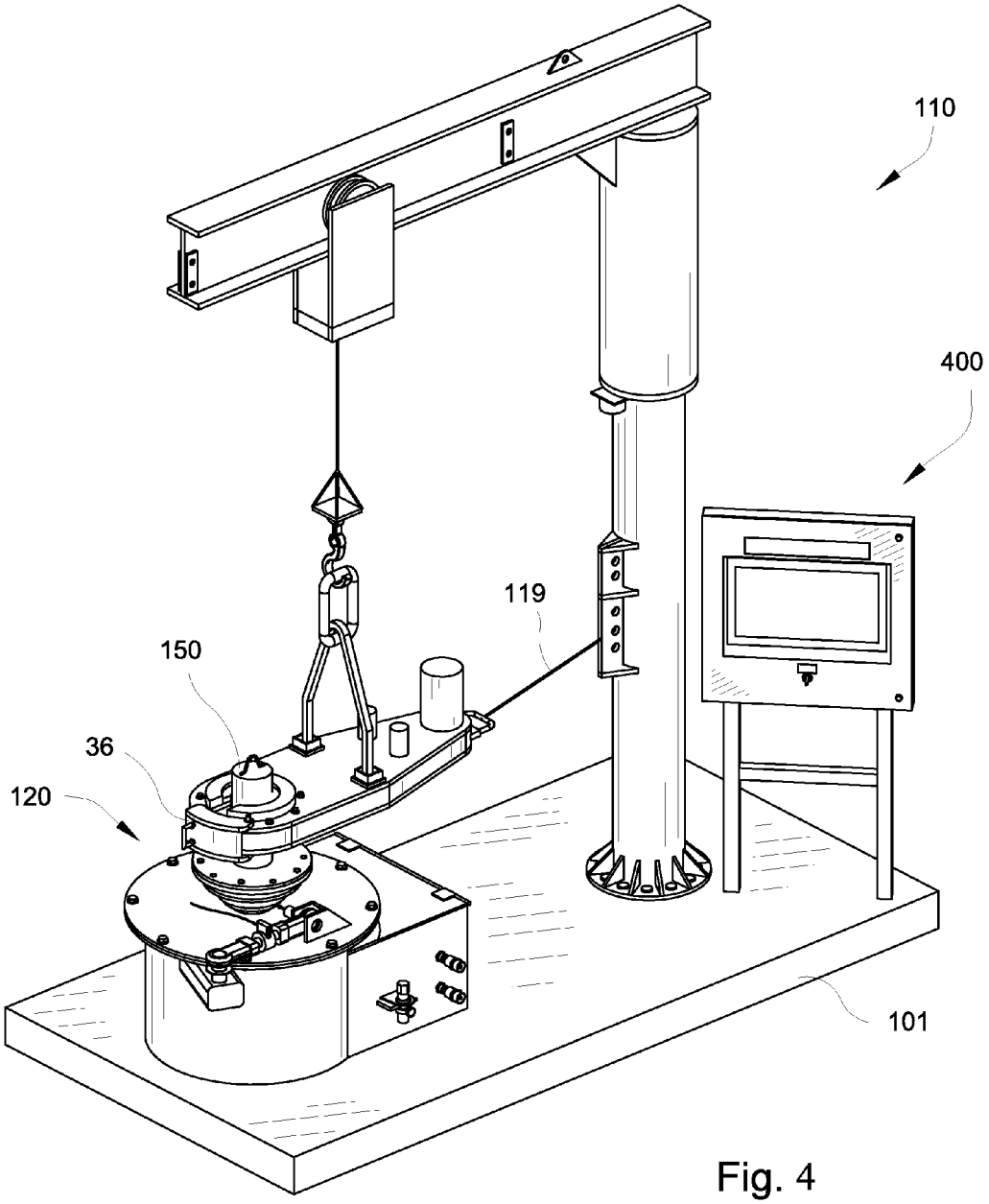

Turning now also to FIGS. 3-6, a particular embodiment of the present invention includes platform 101 supporting tong support structure 110, single disk tong test stand 120, and control system 400. Tong support structure 110 comprises mast 111 standing atop platform 101 and extending upward to swivel crane 113 adapted to swing beam 114 in a limited arc between an operating position as shown in FIGS. 3-4 and a rest position (not shown) whereby power tong 30 may rest upon the ground, a floor, or even drilling rig platform 11. Winch block 115 rolls by casters 116 along beam flange 117 between stops 118. At its proximate position closest to mast 111, winch block 115 brings the rear of power tong 30 close to mast 111 where tether 119 is made up to limit rotation of power tong 30 when in operation. At its distal position (FIG. 4), winch block 115 lowers power tong 30 into place atop test stand 120 where jaws 36 engage and close around mandrel 150.

Figure 5:
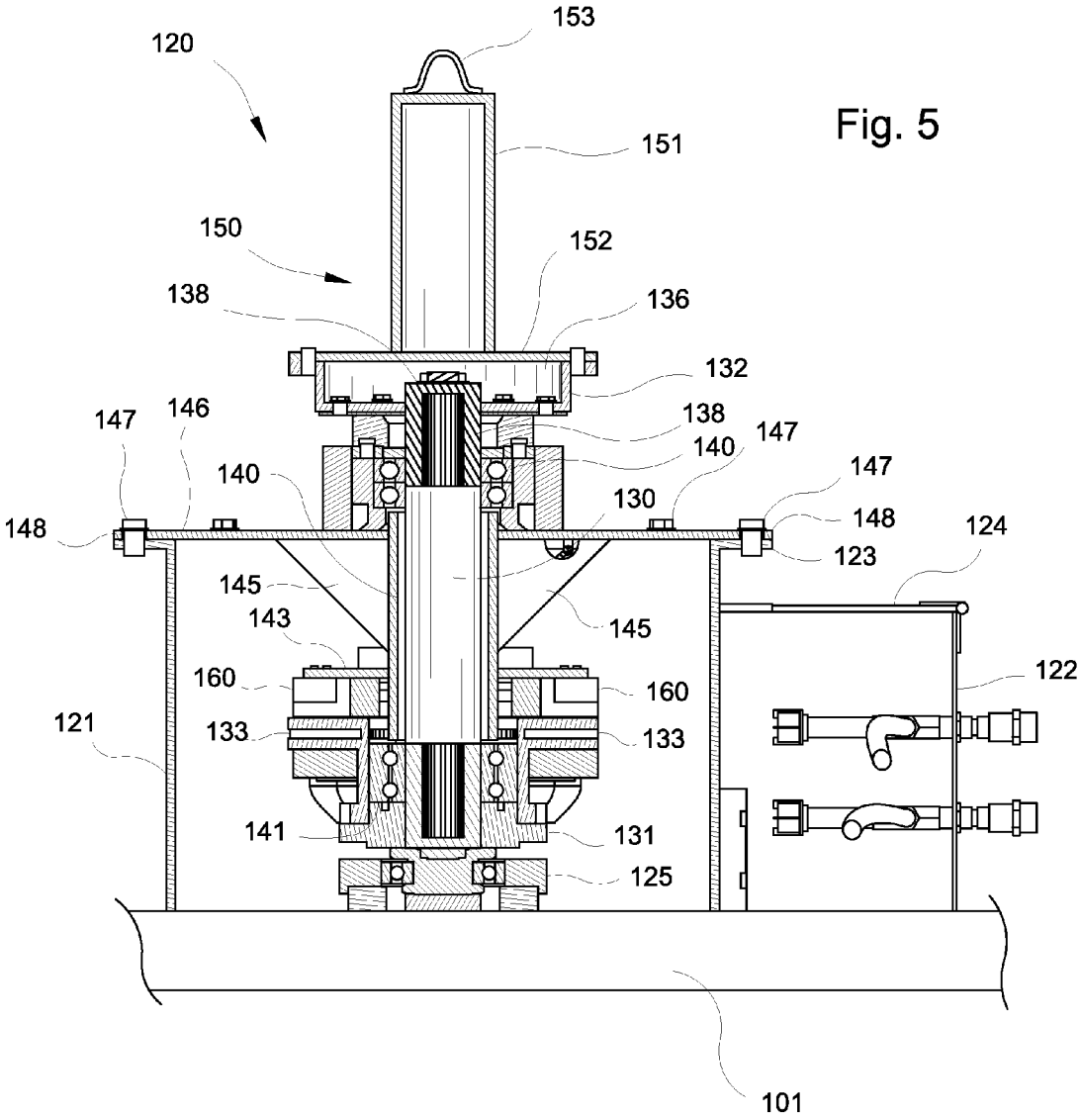
FIG. 5 shows a partial side elevational section of the particular embodiment of the power tong test stand of FIGS. 3-4.
Figure 6:
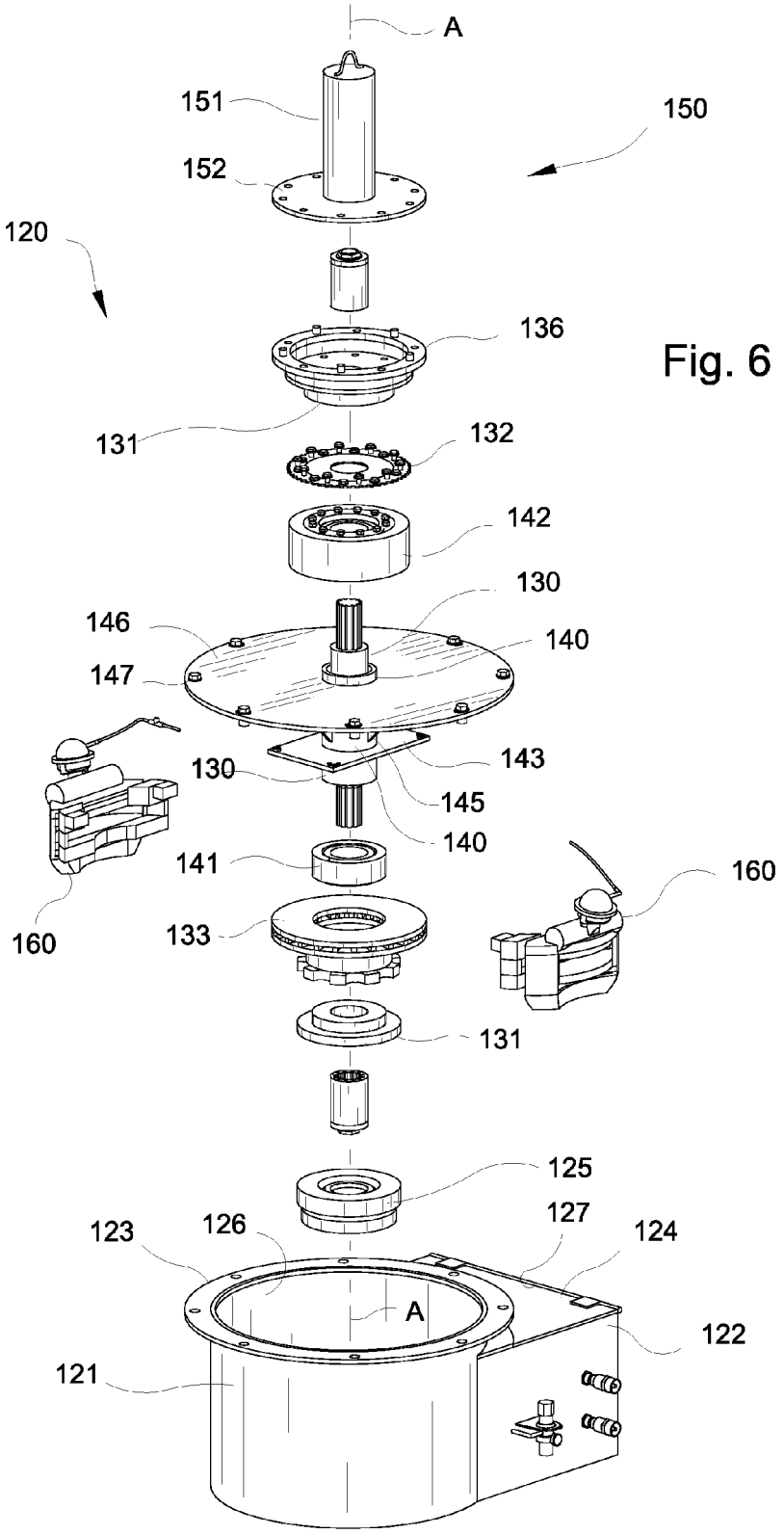
FIG. 6 shows a vertically exploded representation the power tong test stand used with the particular embodiment of the present invention of FIGS. 3-5.
Figure 7B:
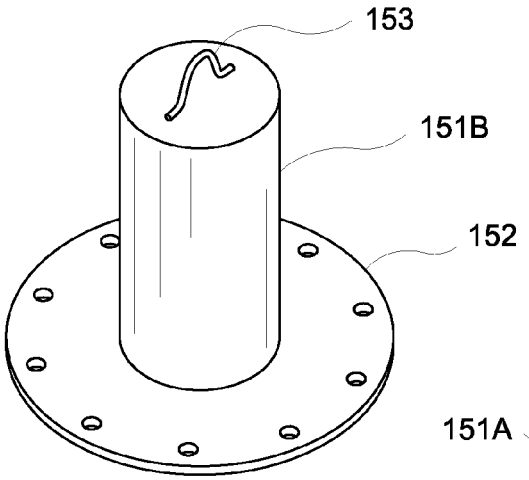
FIGS. 7A-7D detail alternate embodiments of a mandrel used with the power tong testing system of the present invention.
Figure 7A:
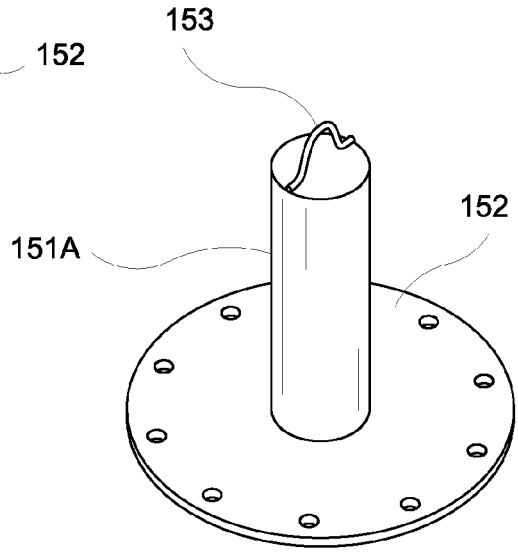
Figure 7D:
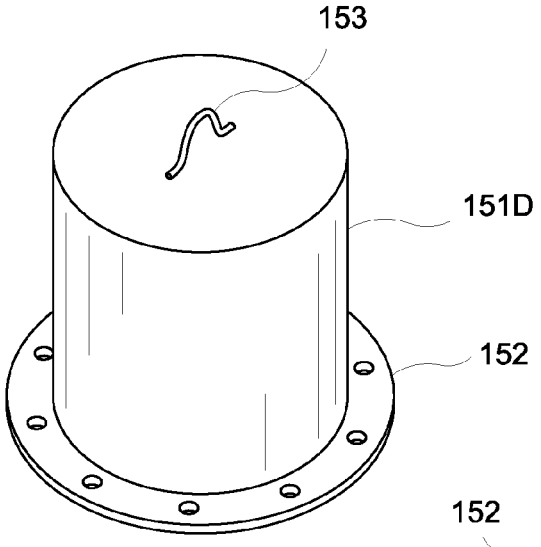
Figure 7C:
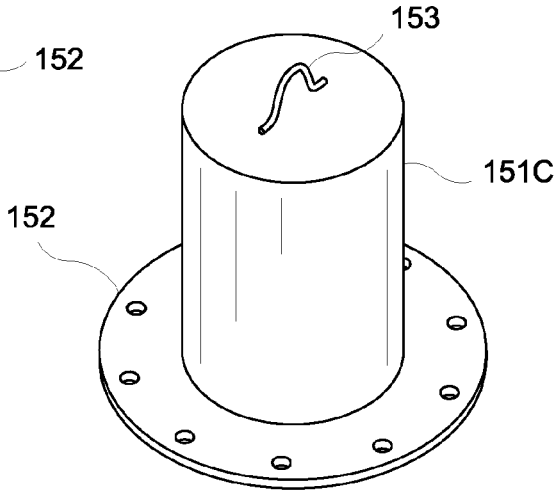

As best seen in FIGS. 5-6, single disk test stand 120 comprises substantially cylindrical, drum-shaped base 121 resting upon platform 101 and bearing adjunct cabinet 124. The walls of base 121 surround and define chamber 126 and shield workers standing near platform 101 from potential hazards during operation of test stand 120. Cabinet 124 also defines cabinet interior 127 accessible through hinged door 124. Cabinet 124 contains pneumatic and hydraulic sensor equipment adjunct to test stand 120, as discussed in more detail below.

Figure 8A:
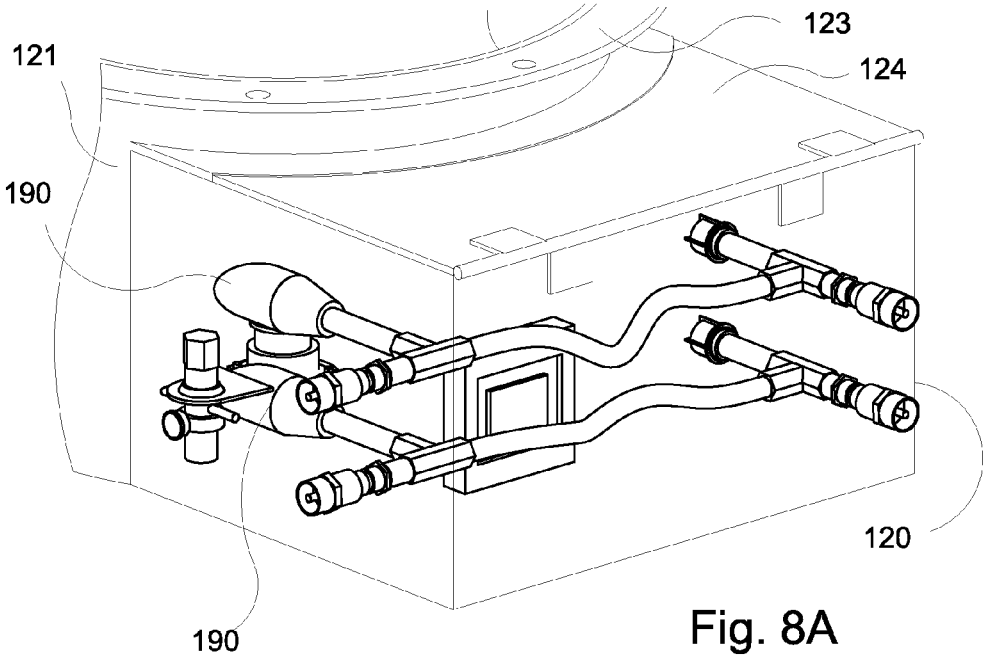
FIGS. 8A-8E detail various sensors used as part of the present invention.
Figure 8B:
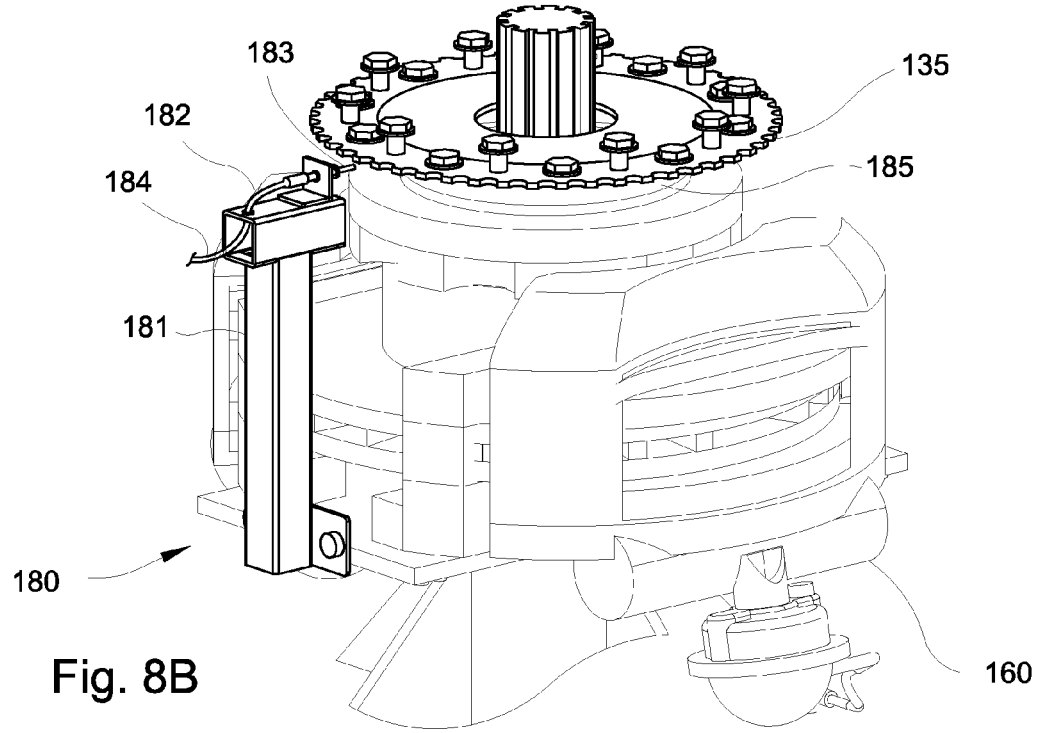
Figure 8C:
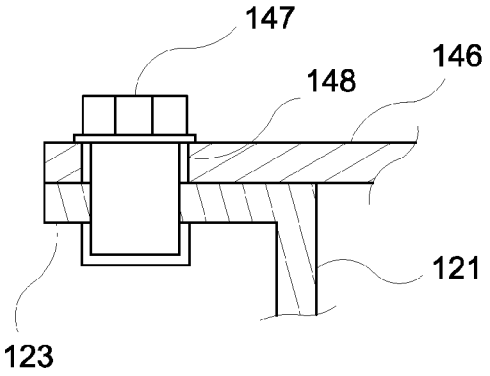
Figure 8D:
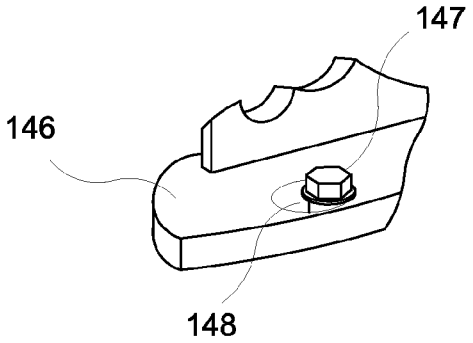

Atop base 121, load bearing flange 123 forms an annular ring surrounding the perimeter of base 121 and extending radially outward therefrom a select distance. Resting and supported atop load bearing flange 123, support flange 146 comprises a circular plate of substantially the same diameter as the outside diameter of load bearing flange 123. A plurality of bolts 147 secure support flange 146 to load bearing flange 123. Oval bolt holes 148 through support flange 146 are arrayed around the perimeter of support flange 146 with their long axes oriented tangent to a bolt hole radius (not shown) from vertical axis A. This permits support flange 147 to rotate about axis A by a small angular degree, as discussed in more detail below in conjunction with FIG. 8C.

Support flange 147 surrounds and supports vertical outer slip tube 140 disposed coaxial with base 121 and extending a spaced vertical distance into chamber 126. Gussets 145 brace and reinforce slip tube 140 against support flange 146 and hold slip tube 140 aligned with axis A. Caliper support plate 143 extends radially outward from slip tube 140 a spaced distance below support flange 146.

Journaled inside and coaxial with slip tube 140, vertical shaft 130 rests upon shaft support bearing 125 disposed on the floor of chamber 126 within cabinet 121. Shaft 130 extends upward through slip tube 140 to terminate a spaced distance above support flange 146. Shaft 130 is held in place by lower shaft bearing 141 disposed at the bottom end of slip tube 140 and upper shaft bearing 142 disposed atop slip tube 140 above support flange 146. Shaft 130 thus is free to rotate coaxially within slip tube 140 while slip tube 140 remains substantially stationary.

Disposed on and coupled to shaft 130 below lower shaft bearing 141, lower hub 131 rotates with shaft 130 below the bottom end of slip tube 140. Keyway and key 137 (FIG. 6) assure that hub 131 and shaft 130 rotate together, and that hub 131 cannot slip coaxially in relation to shaft 130. In an alternate embodiment to keyway and key 137, splines on the end of shaft 130 cooperate with corresponding teeth (neither shown) within hub 131 to prevent slippage. One having ordinary skill in the art will recognize that any such methods of securing hub 131 to shaft 130 and preventing angular rotation of one relative to the other are considered to be within the spirit and scope of the present invention.

Coupled to the upper surface of lower hub 131, brake disk 133 also rotates with shaft 130. Disk brake rotor 133 extends radially outward a spaced distance from axis A. Calipers 160 mounted to caliper mounting plate 143 cooperate with rotor 133 to stop rotation of shaft 130 in response to instructions from control system 400, as discussed in further detail below. At least two calipers 160 are arrayed evenly around the perimeter of rotor 133 to assure balanced forces on rotor 133 and shaft 130 when calipers 160 operate. One having ordinary skill in the art will recognize that any number of calipers 160 could be arrayed around rotor 133 without departing from the spirit and scope of the present invention, and that the more calipers 160 that are arrayed around rotor 133, the greater the stopping power of test stand 120 in resistance to rotation of shaft 130.

Preferably, calipers 160 are capable of exerting up to approximately nineteen thousand (19,000 ft.-lbs.) foot-pounds of torque each without allowing rotor 133 to slip. Thus, for single rotor testing system 100 under discussion is capable of testing tongs having a torque capacity of approximately thirty-eight (38,000 ft.-lbs.) foot-pounds. Suitable disk brakes, including calipers 160 and rotor 133 are available as catalog number ADB22X from Bendix Corporation of Elyria, Ohio, USA.

Coupled to the top of shaft 130 above support flange 146, upper hub 132 is affixed to shaft 130 in manner similar to lower hub 131 discussed above. Extending upward from the top surface of upper hub 132, top hub adapter 136 also rotates with shaft 130. Top hub adapter 136 provides mounting bolts and a mounting position for mandrel 150 disposed atop shaft 130. Mandrel flange 152 extends radially outward from mandrel mast 151 to a like diameter as hub adapter 136, while mandrel mast 151 extends coaxially upward therefrom a spaced distance. Mandrel mast 151 is adapted to be received within jaws 36 of power tong 30, whereby power tong 30 rotates shaft 130 and rotor 133 until calipers 160 bring such rotation to a halt during testing. As best seen in FIGS. 7A-7D, a selection of mandrels 150A-150D provide respectively masts 151A-151D of varying horizontal diameters to fit jaws 36 of variously sized power tongs 30. Lifting handles 153 abet installation and removal of mandrels 150 atop hub adapter 136 as needed.

Turning now also to FIGS. 8A-8E, several data gathering sensors coupled to test stand 120 include fluid flow sensors 190, speed (RPM) sensor 180 and torque sensor 170. Each of these sensors gather numerical data and transmit it to control system 400, as discussed below. Fluid flow sensors 190 are adapted to track incident and return air pressures within the pneumatic power system of test stand 120. Both pressure measurements are relayed to control system 400 for coordination and correlation with other measurements. Suitable pneumatic pressure sensors are available as catalog number AST4000 from American Sensing Technologies, Inc. of Budd Lake, N.J., USA.

Speed, or RPM sensor 180 monitors the rotation speed of shaft 130. Disposed beneath upper hub 132 and above upper shaft bearing 142, timing plate 135 comprises a circular disk rotating with shaft 130. Detents, or serrations 186 disposed around the outside perimeter of timing plate 135 present reflective variations of light by which strobe 183 may pace the rotation of shaft 130. Strobe sensor 183 transmits its data to control system 400 for correlation with other data. Sensor 183 is held in position just outside the perimeter of timing plate 135 by mounting arm 181. Preferably, mounting arm 181 is affixed atop support flange 146.

Figure 8E:
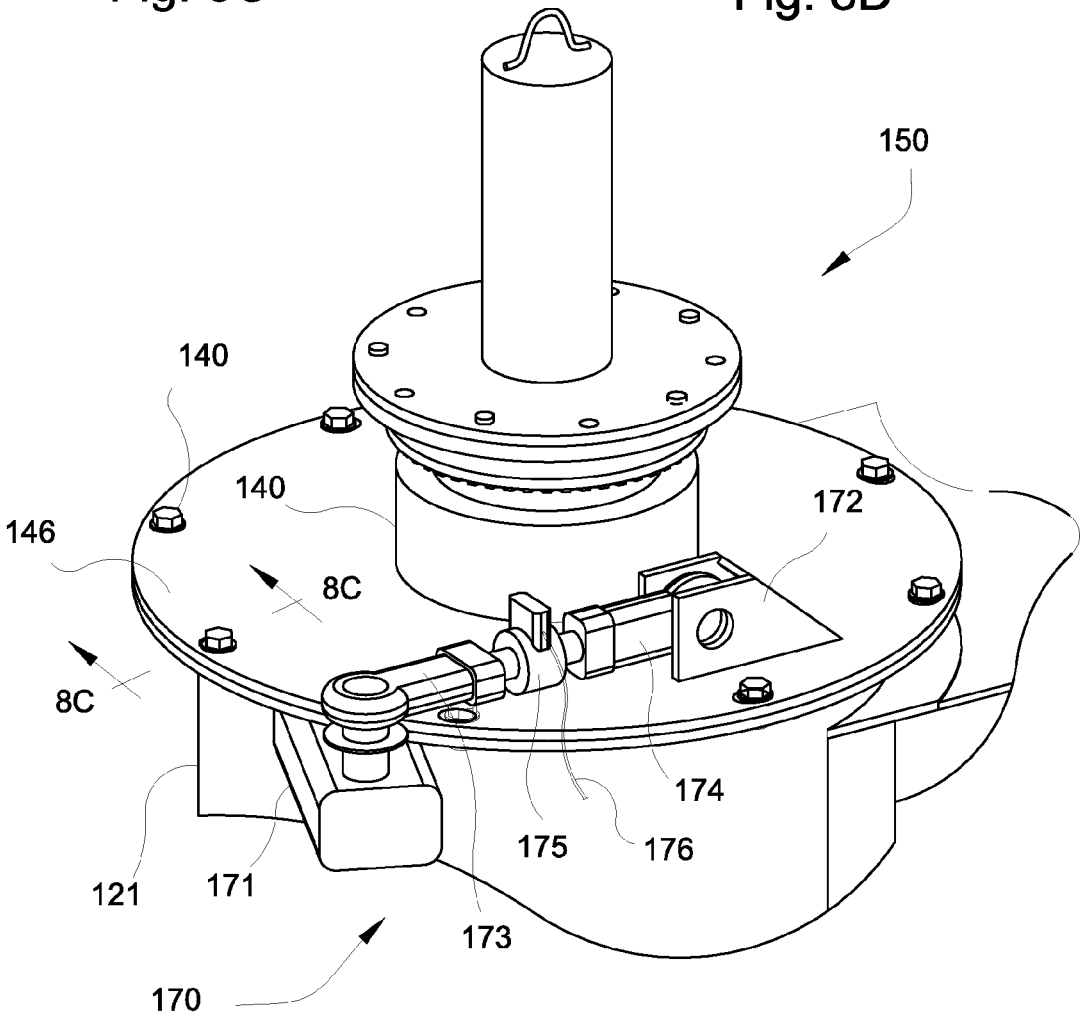
Figure 9:
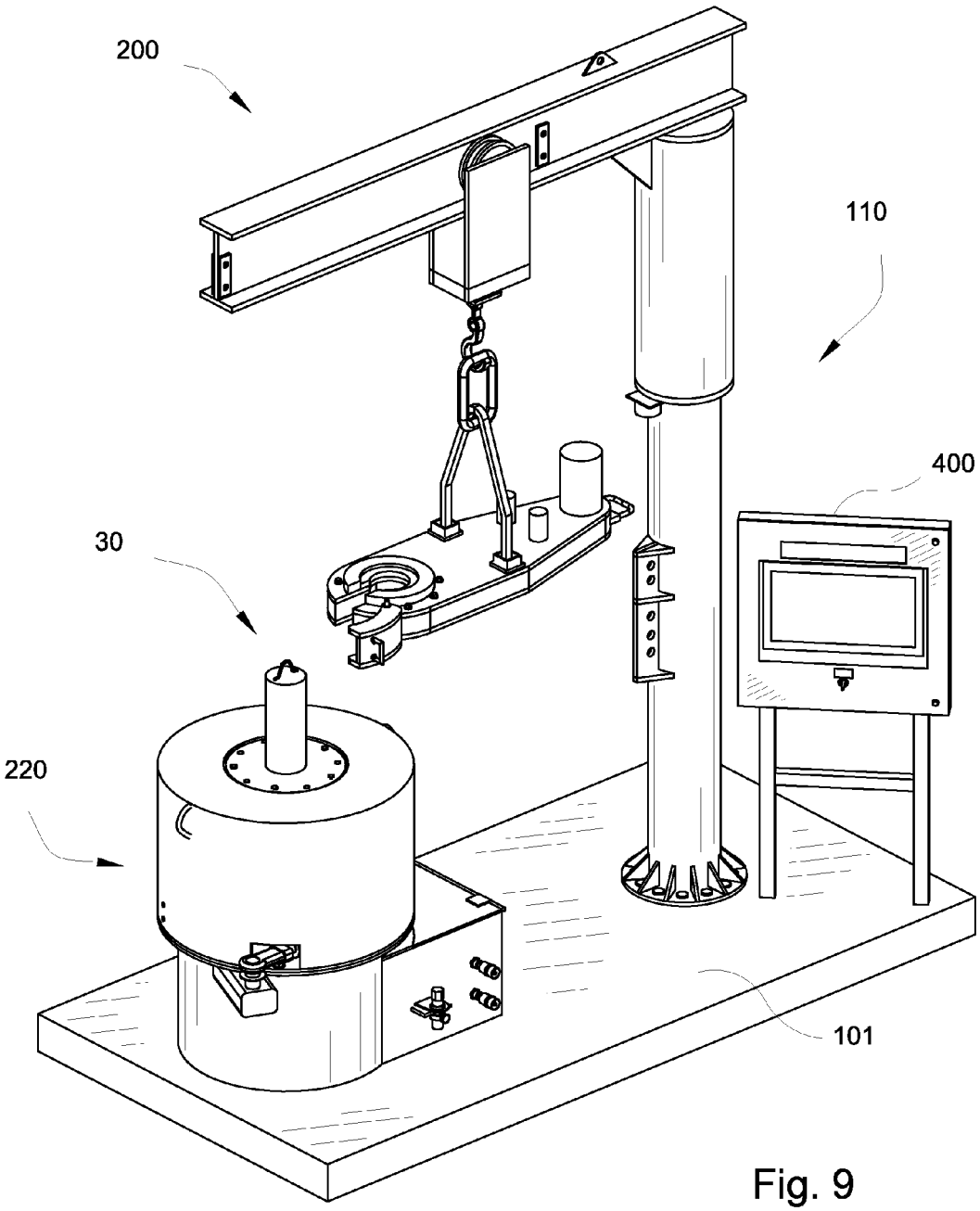
FIGS. 9-10 depict another particular embodiment of the tong testing system of the present invention.
Figure 10:
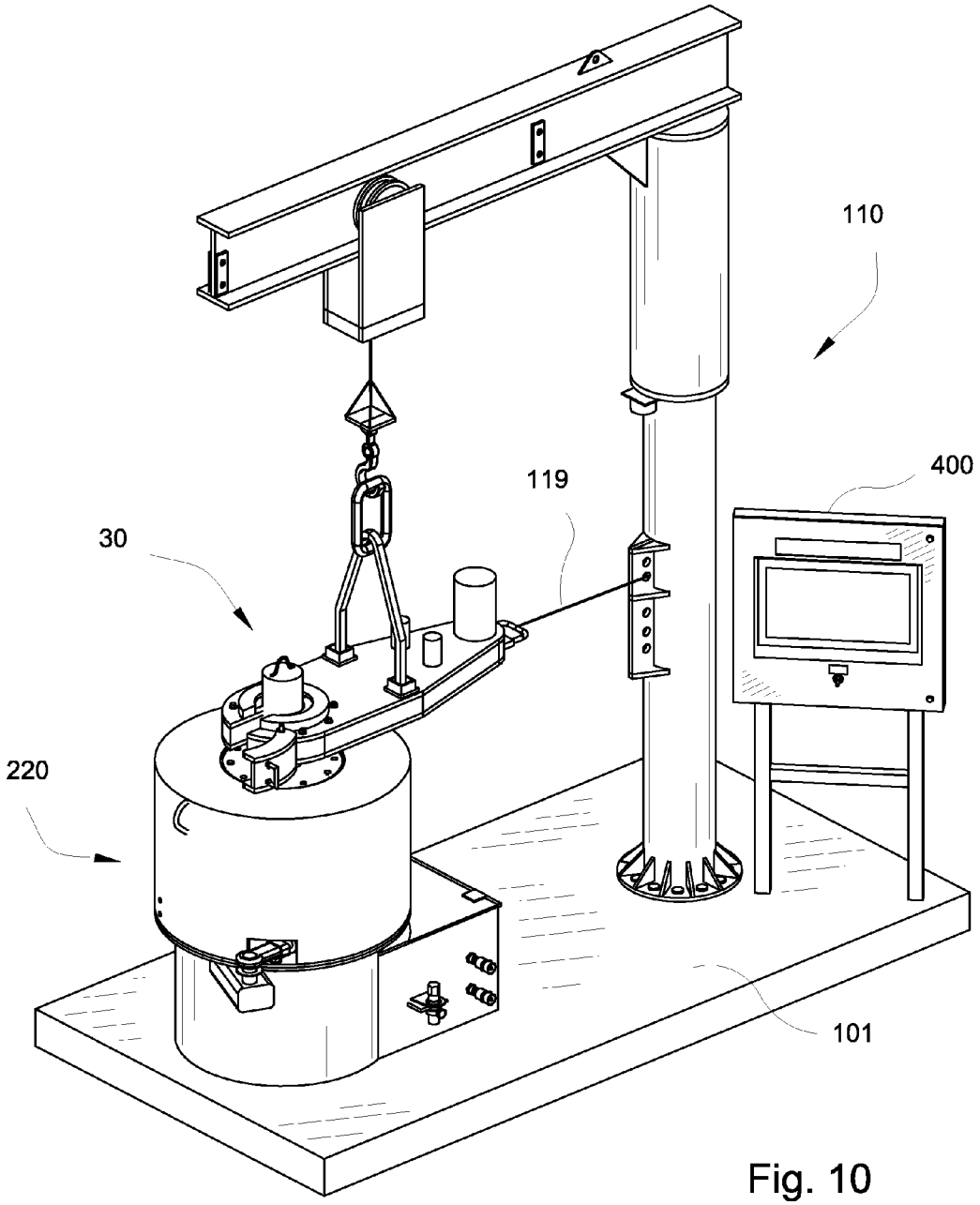
Figure 11:
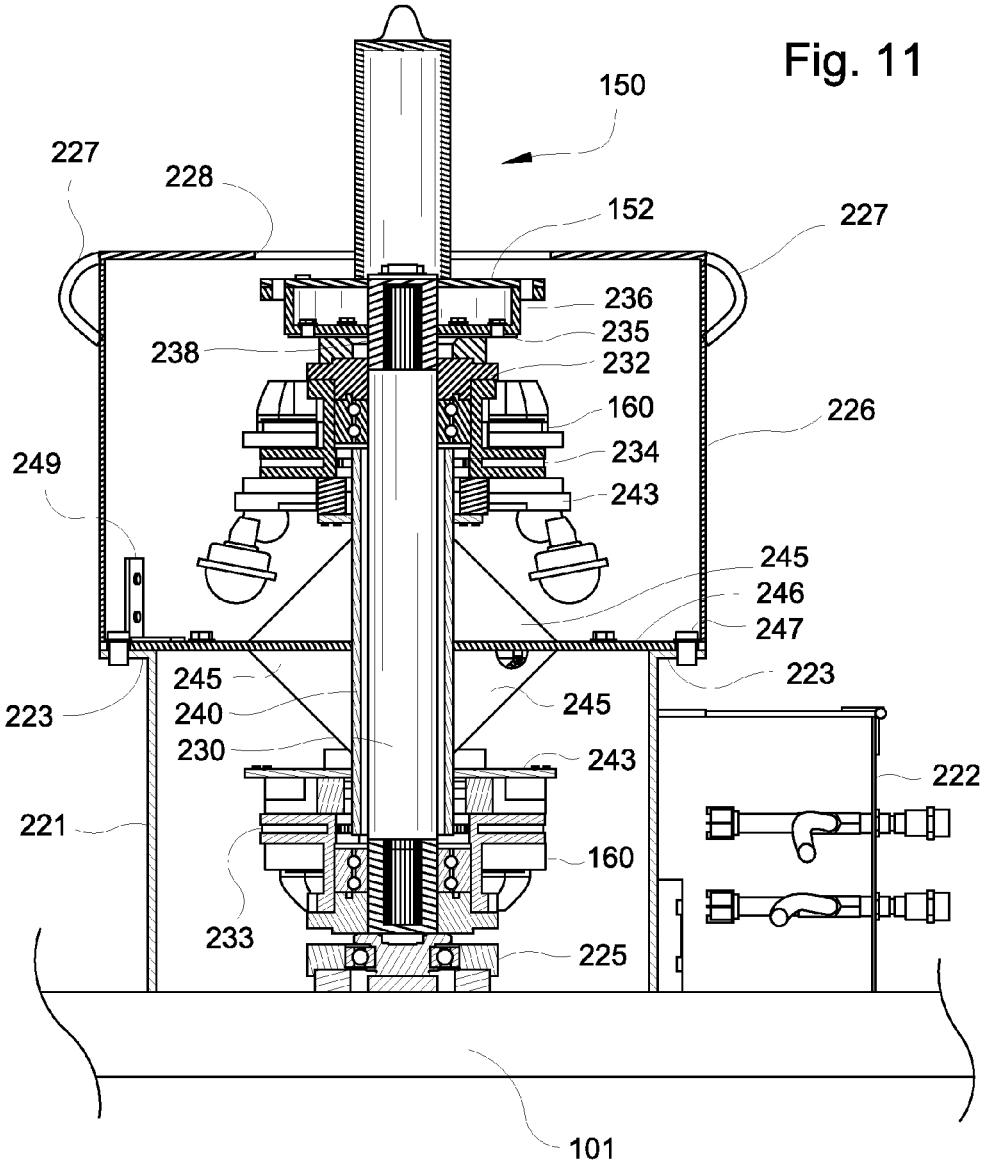
FIG. 11 shows a partial side elevational section of the particular embodiment of the power tong test stand of FIGS. 9-10.
Figure 12:
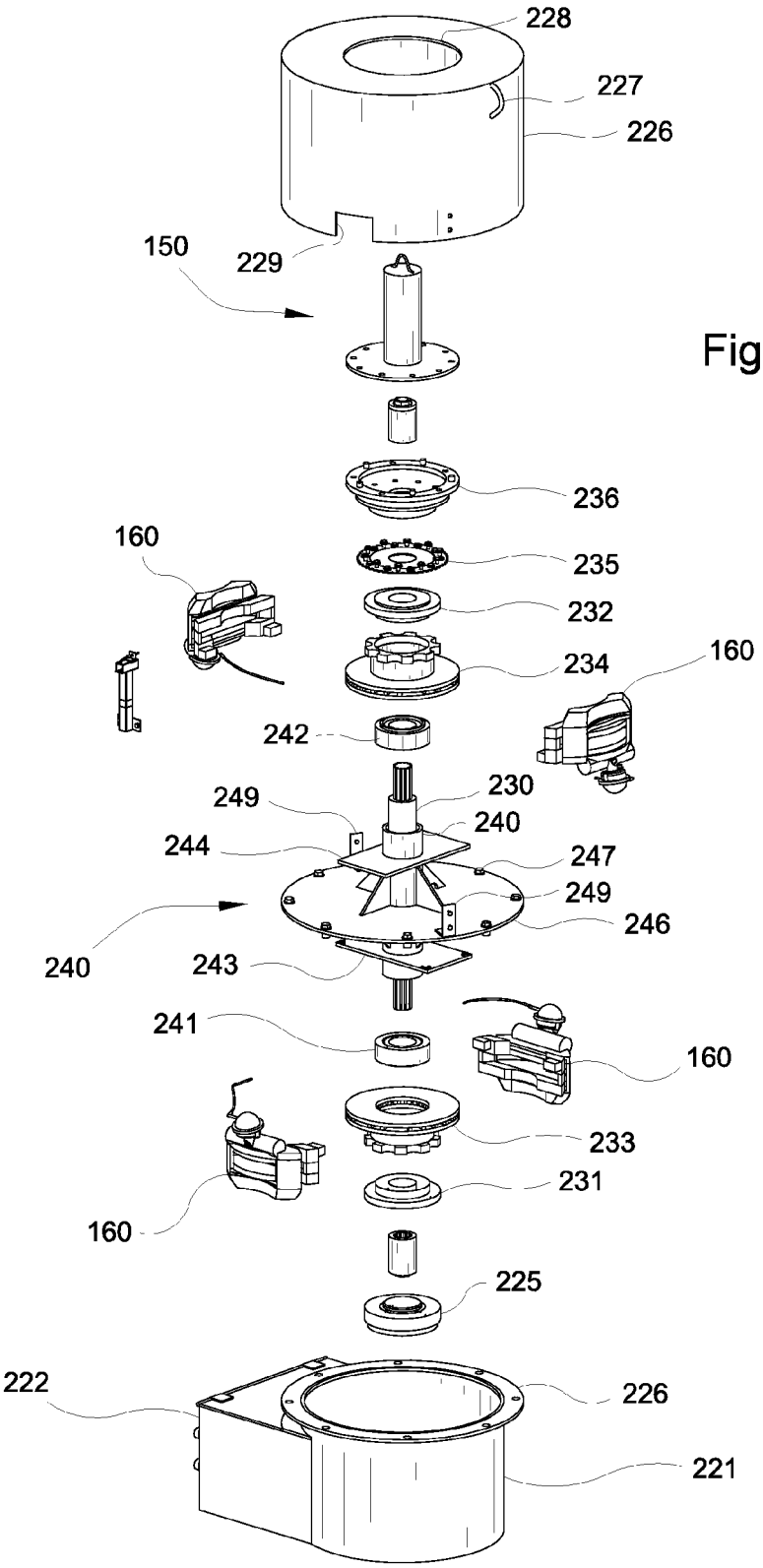
FIG. 12 shows a vertically exploded representation the power tong test stand used with the particular embodiment of the present invention of FIGS. 9-11.

Torque is the primary test criterium for test stand to determine. If power tongs 30 exert sufficient torque, they may be certified. As best seen in FIG. 8E, stationary torque arm 171 extends from base 121 a spaced distance outside its vertical walls to support the fixed end 173 of torque sensor 170. Lug 172 mounted to support flange 146 (see FIG. 8E) supports opposite, movable arm 174 of torque sensor 170, which reaches toward end 173. Coupled in between arms 173, 174, load cell 175 measures the minute, spacial change in distance between arms 173, 174 during testing and transmits this data to control system 400, which converts it to a torque measurement. A suitable load cell 175 is available as catalog number LC702-50K from Omegadyne Company of Sumbury, Ohio, USA.

This torque measurement is correlated by control system 400 with other sensor data, and contrasted to power tong library standard measures available for power tong 30 and required to be met for certification. For torque sensor ends 173, 174 to move relative to each other, support plate 146 must be able to rotate about axis A at least a small angular distance. Hence, bolt holes 148 (FIGS. 8C-8D) must permit such relative movement between support flange 146 and load bearing flange 123. Preferably, ovate holes 148 are at least two (2") inches long on their long axis tangent to their radius about axis A.

Multiple Disk Test Stand

Turning now also to FIGS. 9-12, another particular embodiment of the present invention is adapted for testing power tongs of greater torque output capability that is single disk test stand 120. Double disk test stand 220 includes the features discussed above for single disk test stand 120. Specifically, shaft 230 has on its lower end within chamber 226 of base 221 substantially the same lower hub 231 and lower rotor 233 and calipers 160 as discussed above. The difference occurs outside chamber 226 and above support flange 246. Shaft 230 and slip tube 240 extend further above support flange 246 to accommodate another disk brake, effectively doubling the torque capabilities of dual disk test stand 220 relative to single disk test stand 120.

Mounted near the top of slip tube 240, upper caliper support plate 244 supports a second set of calipers 160 which cooperate with upper rotor 234 mounted to upper hub 232 and extending downward therefrom toward support plate 246. Upper caliper mounting plate 244 also is arrayed at ninety (90 deg.) degrees to lower caliper mounting plate 243, thereby placing calipers 160 out of phase with calipers 160 mounted to lower caliper mounting plate 243, thereby to evenly distributing the torque applied to shaft 230. As discussed above for single disk test stand 120, top hub adapter 236 bolts to upper hub 232 to support mandrel 150 to which power tong 30 couples for testing. Thus, test stand 220 is capable of stopping rotation of shaft 230 when it is driven by tongs 30 providing up to twice the torque that test stand 120 can resist.

Surrounding the second rotor and caliper system on dual disk test stand 220, shield 226 comprises a cylindrical steel shell similar to base 221. Shield 226 is lowered over the top of the upper portion of test stand 220 and rests atop support flange 246, affixed thereto by brackets 249. Mandrel 150 extends through aperture 228 in the top of shield 226. Handles 227 abet manipulation of shield 226, and slot 229 fits over torque sensor 170. Shield 226 thus provides similar protection to nearby workers from upper calipers 160 as does base 221 for lower calipers 160.

Integrated Tong Test Stand

Figure 13:
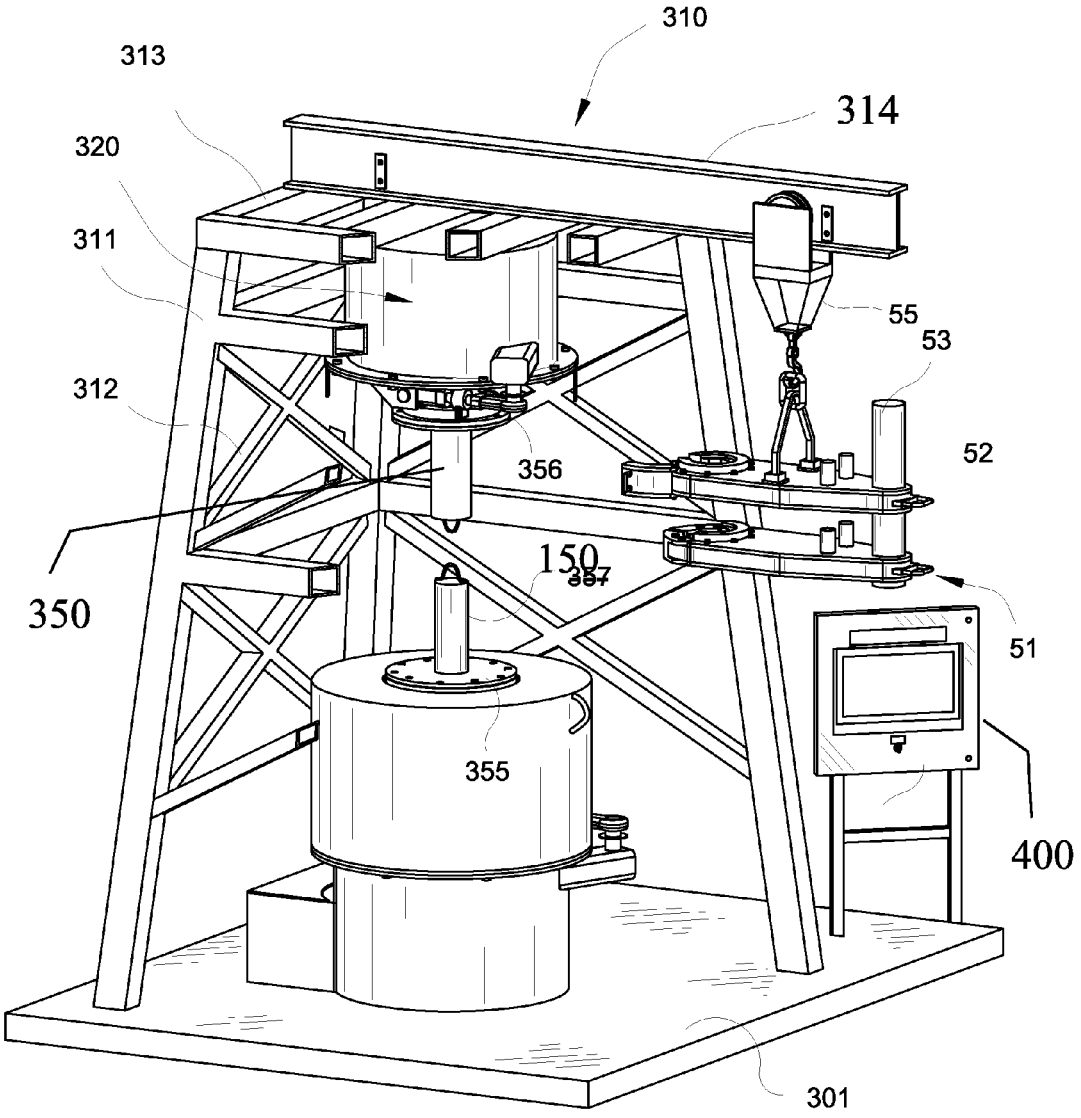
FIG. 13 shows another particular embodiment of the tong testing system of the present invention.

Turning now to FIG. 13 yet another particular embodiment provides means for testing integrated power tongs 50 capable of considerably greater torque output than tongs 30. Because of such greater torque, integrated tongs 50 provide both drive tong 51 and back-up tong 52 in one machine. As was discussed above in conjunction with FIG. 2 for separate backup tongs 40, back-up tongs 52 of integrated tongs 50 grasp down-hole pipe 25 to hold it while upper drive tong 51 rotates stand 23 to a specified tightness. Thus, to test integrated tongs 50, test stand system 300 must provide mandrels for both tongs 51, 52, as well as test stand 320 that is elevated above platform 301.

To accomplish this, derrick 310 straddles platform 301 and is open on one side to permit entry of integrated tong 50. Inverted beneath top floor 313 of derrick 310, second test stand 320 depends from derrick 310 with its mandrel 350 pointed downward toward first test stand 120, 220. Second test stand 320 operates in like manner to single and dual test stands 120, 220, as discussed elsewhere herein. Mandrel 150 of first test stand 120, 220 provides a mast for lower, back-up tongs 52 to grasp, thereby stabilizing integrated tongs 50 while upper tong 51 is tested by second test stand 320. Though the system of the present invention doesn't directly test lower tongs 51, they do receive considerable torque while upper tongs 51 are being tested. If they slip, that gives test personnel a warning that lower tongs 52 need to be investigated as well.

Derrick 310 comprises substantially planar, trapezoidal sides converging at their top to form top floor 313 from which second test stand 320 is suspended. Derrick 310 only has three sides, the fourth being omitted to admit integrated tongs 50 under the impetus of equipment moving it into place (not shown). Integrated tongs 50 are maneuvered into place beneath derrick 310 using winch block 315 and beam 314 disposed atop derrick 310. Alternately, the operator could use a fork lift or the crane bridge (neither shown) of drilling rig 10.

One having ordinary skill in the art will recognize that test stand 320 could be the equivalent of either single test stand 120 or dual test stand 220 without departing from the spirit and scope of the present invention. Alternately, it could be much larger and have much larger rotors (not shown), with six or more calipers 160 arrayed around its perimeter. Such configuration has no theoretical limit on its torque testing capabilities.

Control System

Figure 14B:
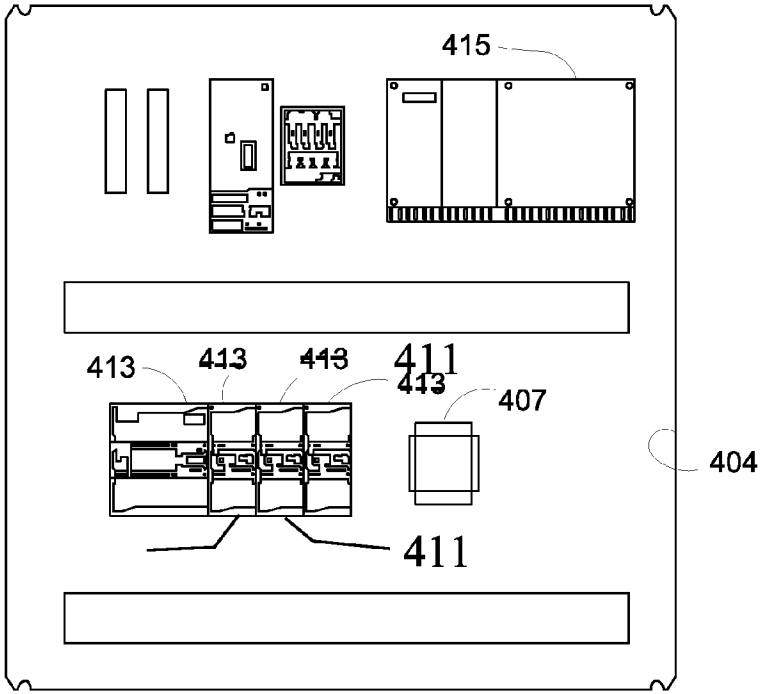
FIGS. 14A-14C detail control system hardware for use with the power tong testing system of the present invention.
Figure 14A:
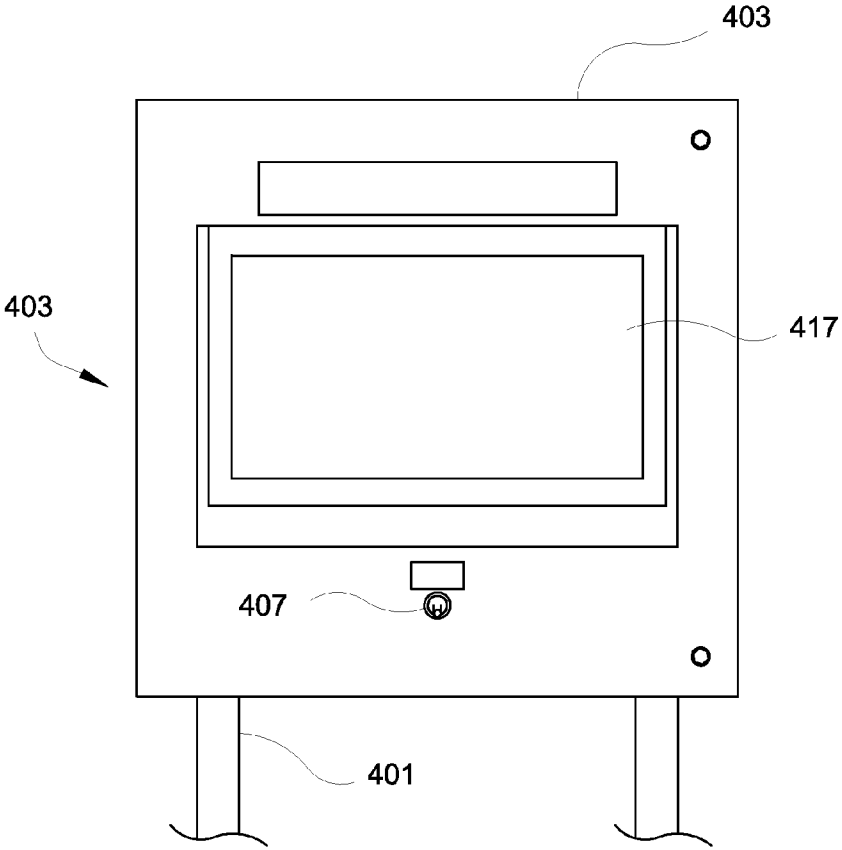
Figure 14C:
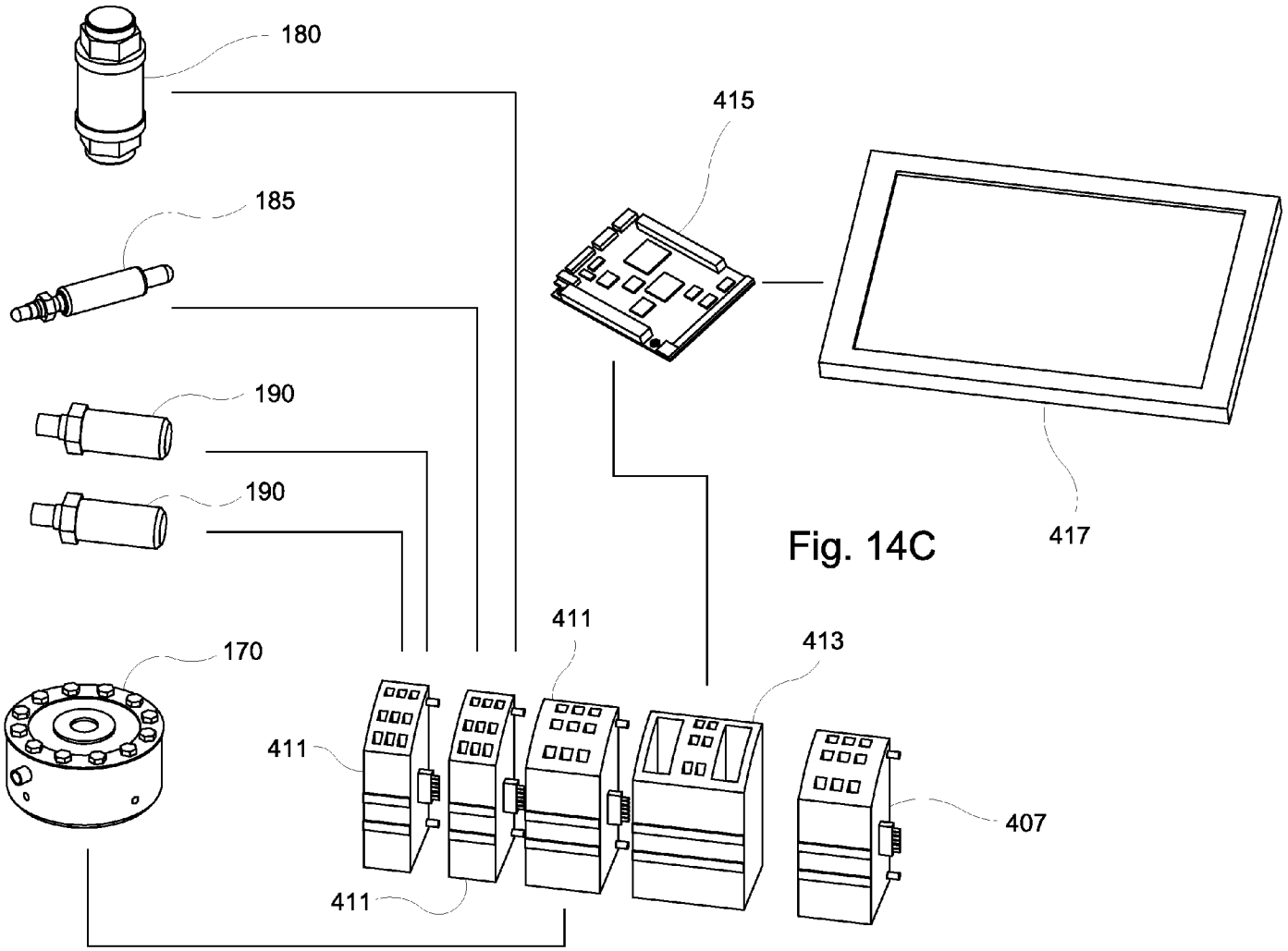
Figure 15A:
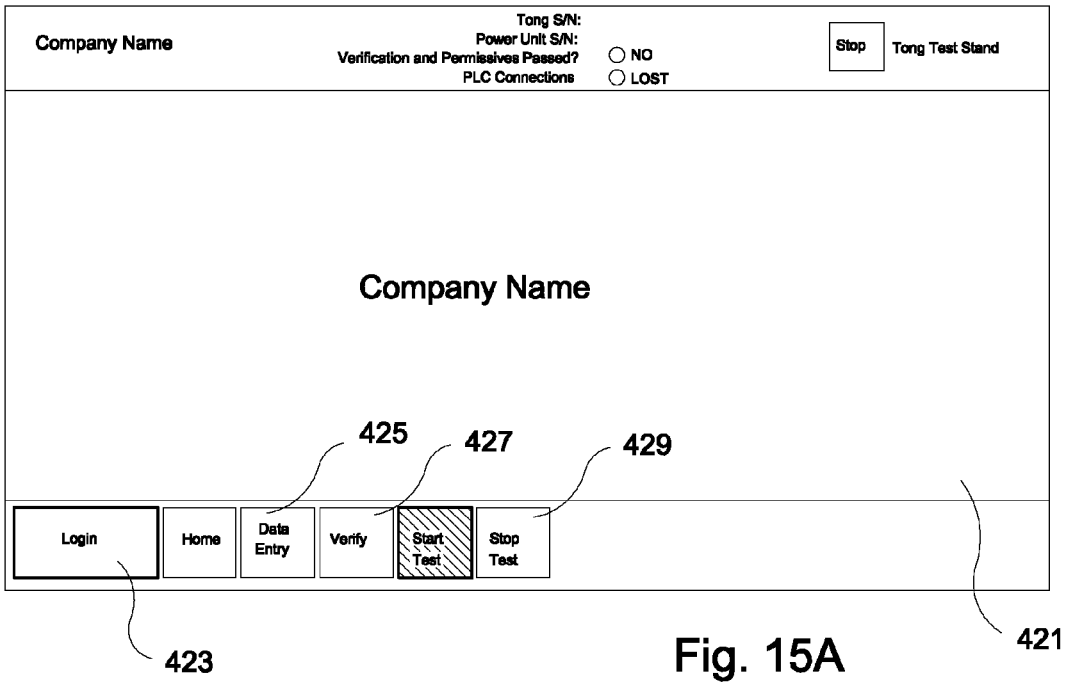
FIGS. 15A-15E show administrator interface screens for modifying user authorities.
Figure 15B:
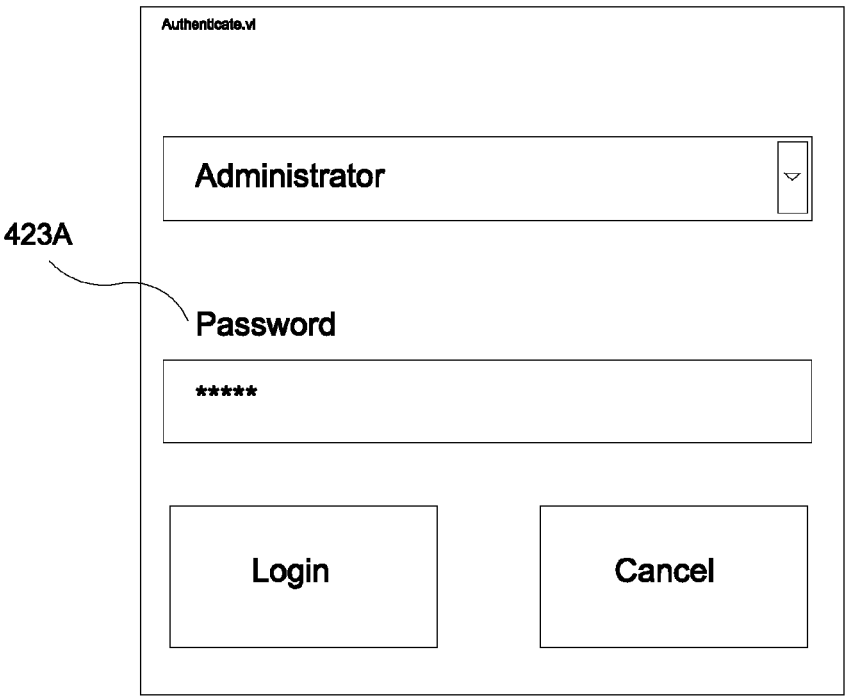
Figure 15C:
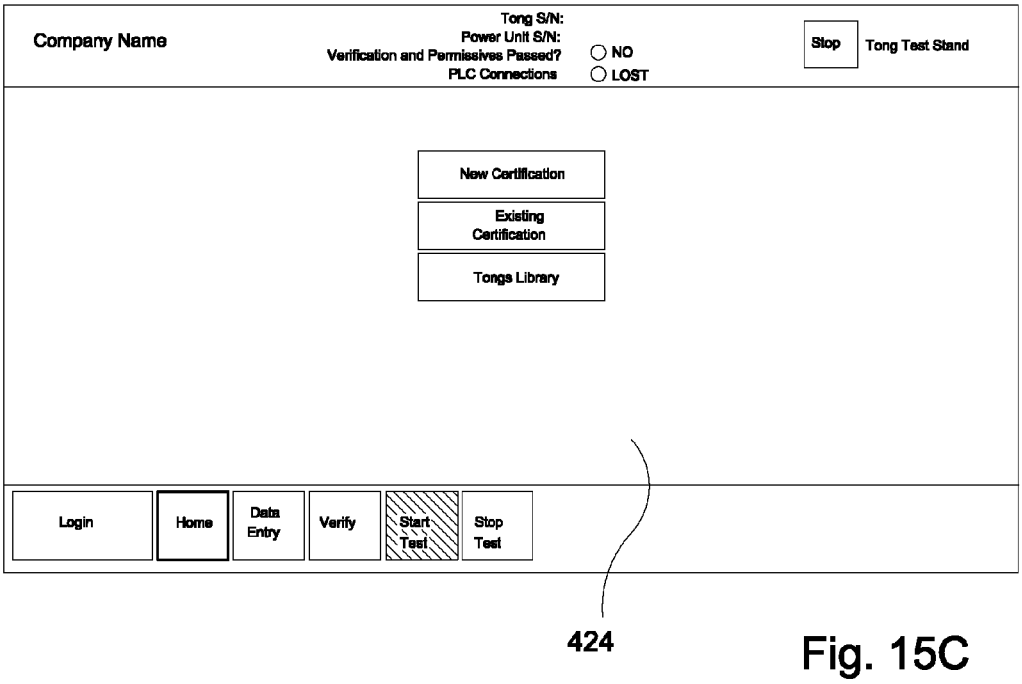
Figure 15D:
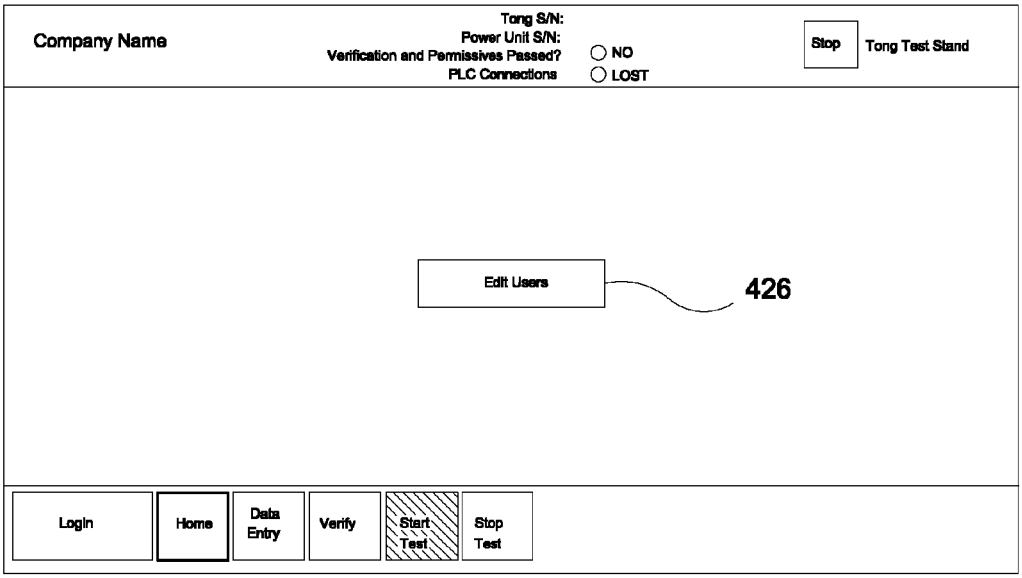
Figure 15E:
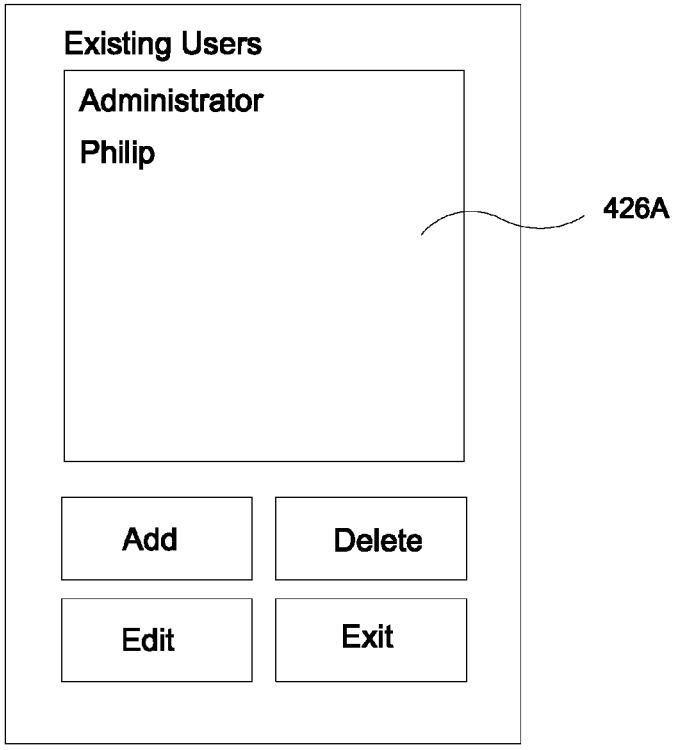
Figure 16A:
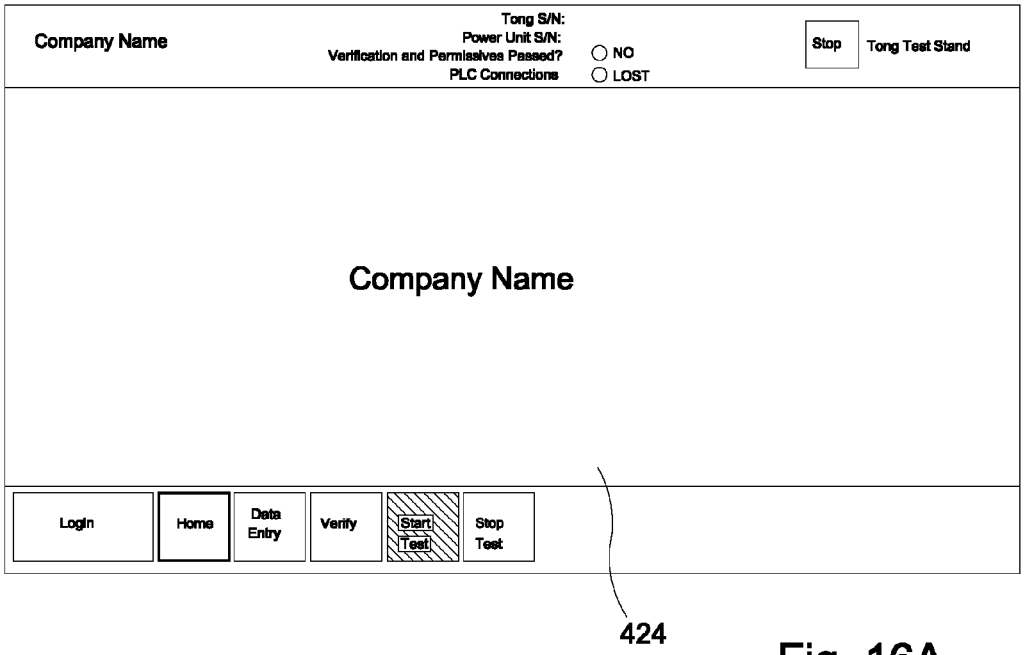
FIGS. 16A-16C detail user interface screens showing initial test setup procedures for a power tong test using the power tong testing system of the present invention.
Figure 16B:
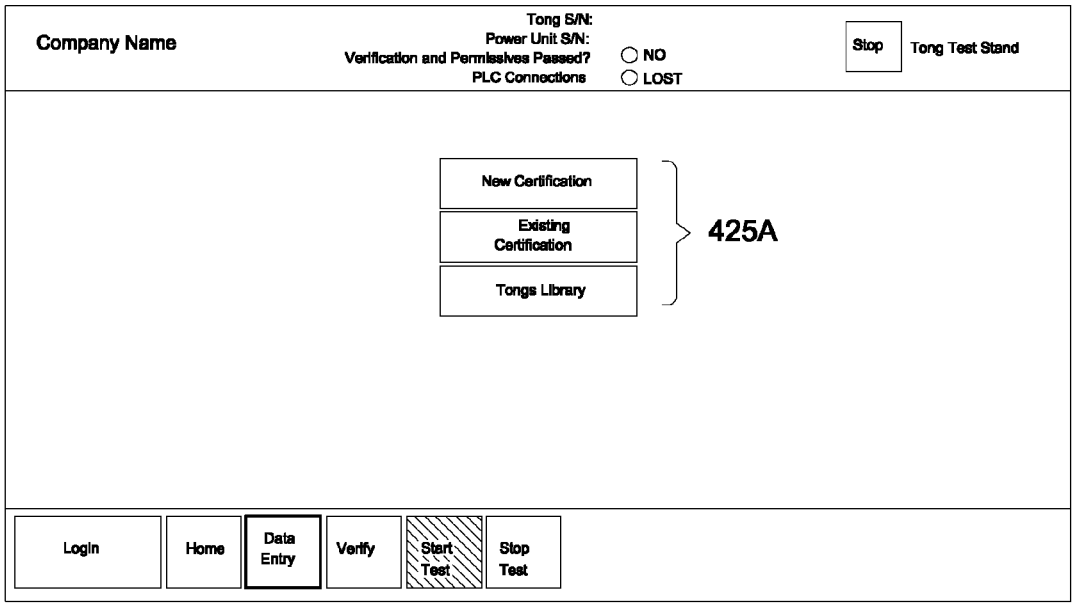
Figure 16C:
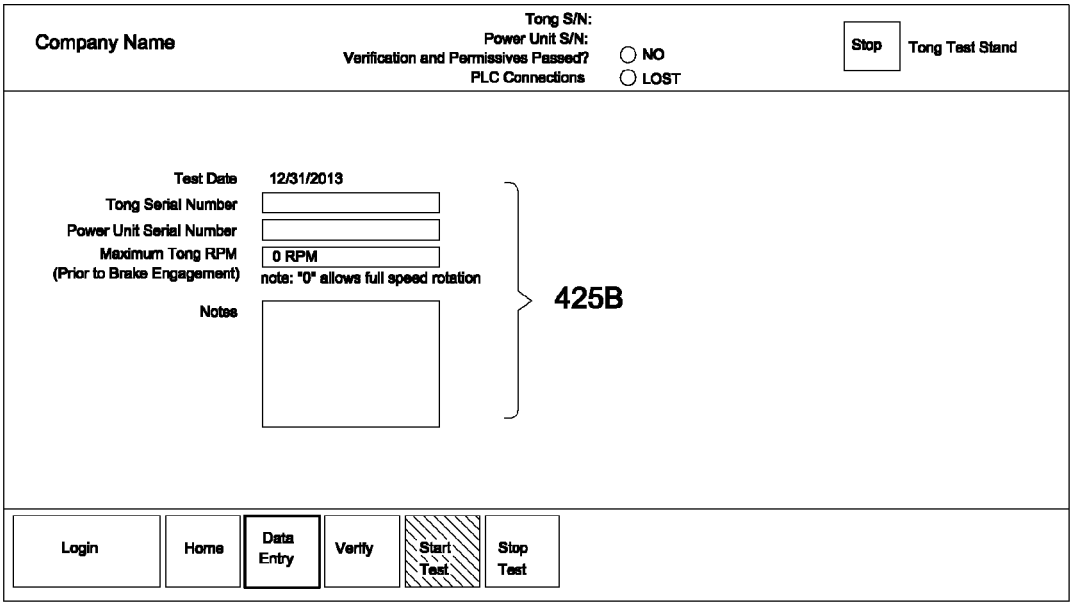
Figure 17A:
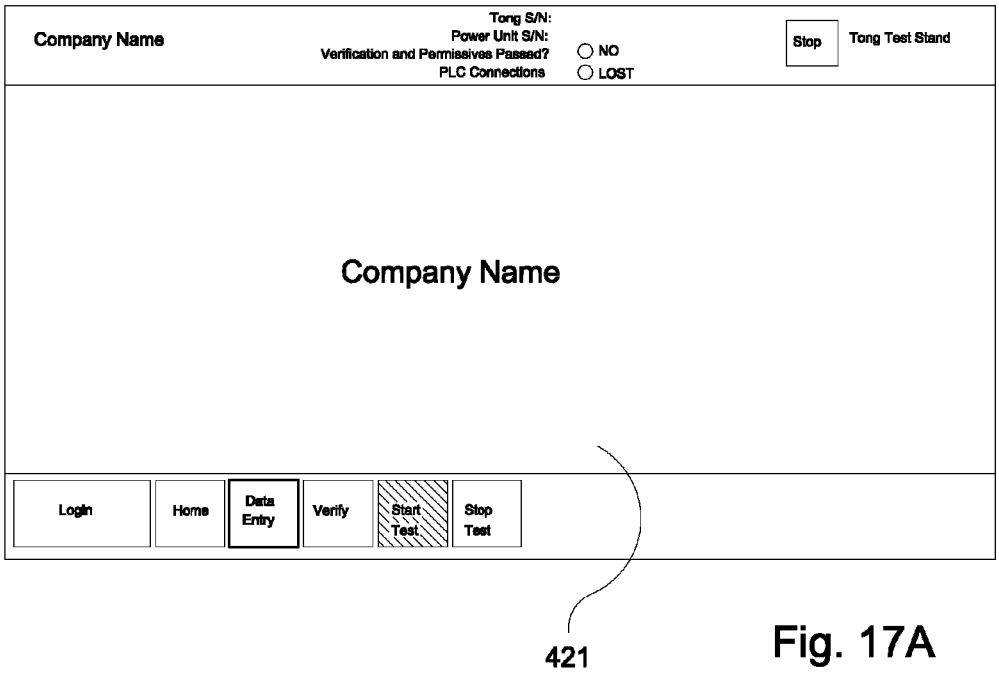
FIGS. 17A-17F shows user interface screens showing test setup parameters for a power tong test using the power tong testing system of the present invention.
Figure 17B:
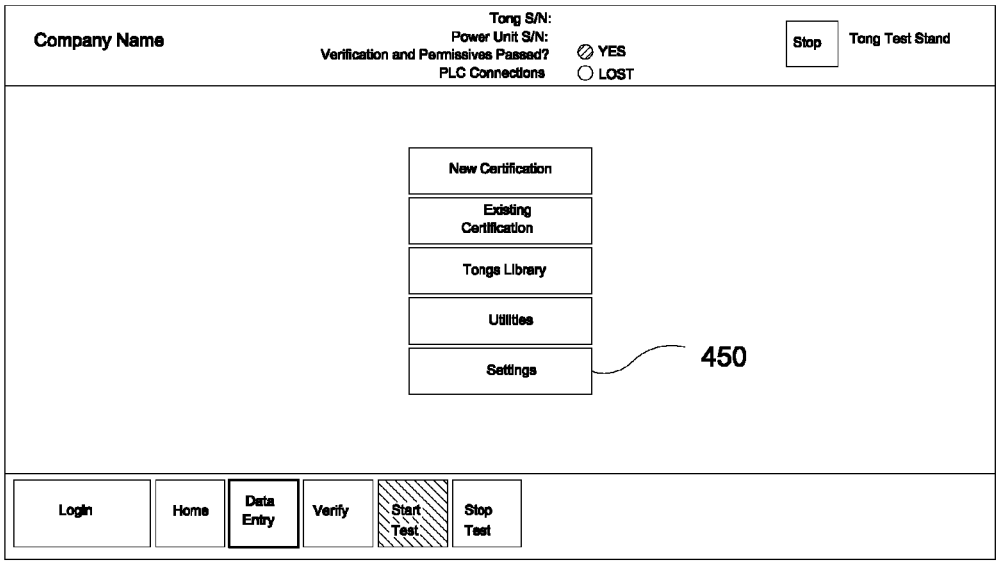
Figure 17C:
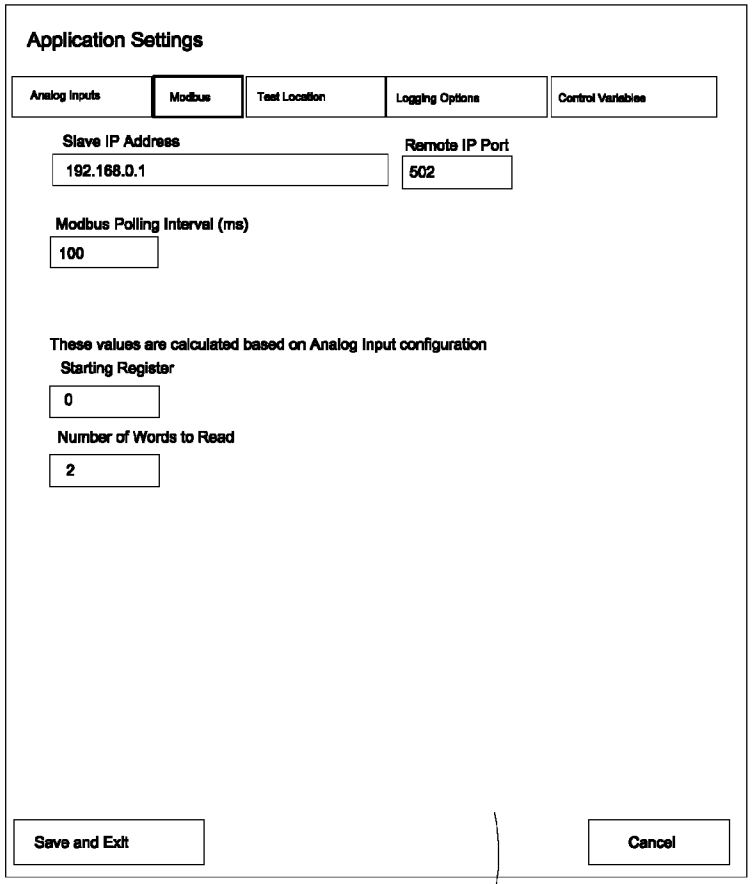
Figure 17D:
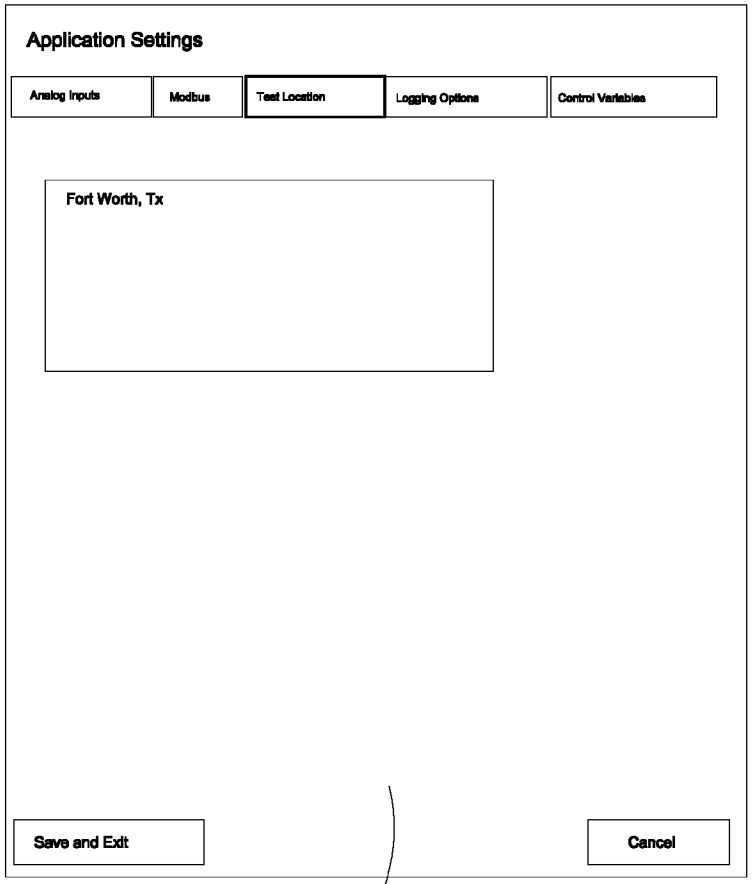
Figure 17F:
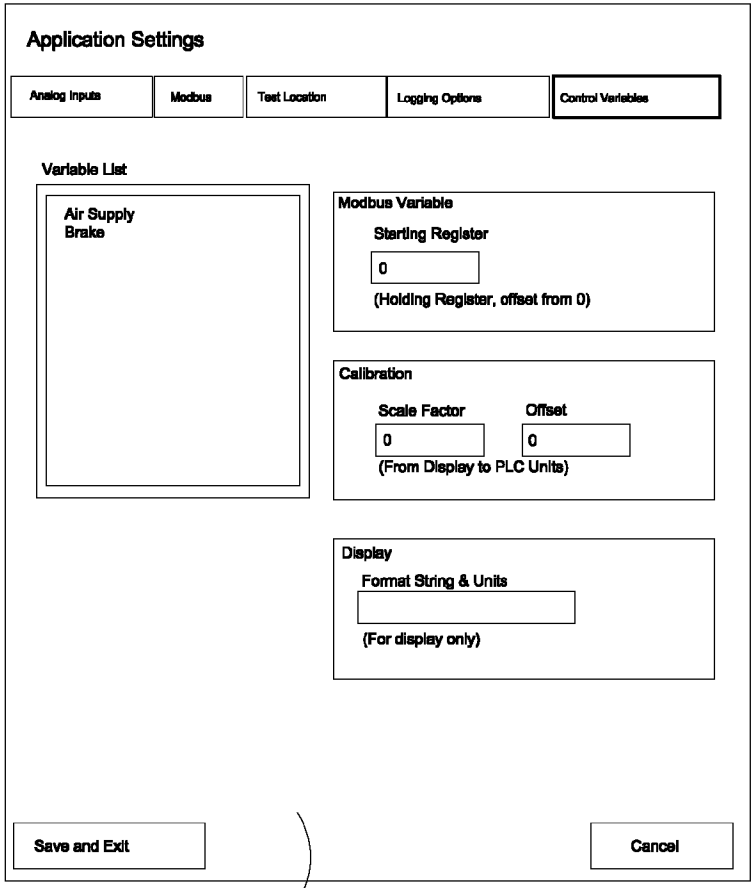
Figure 17E:
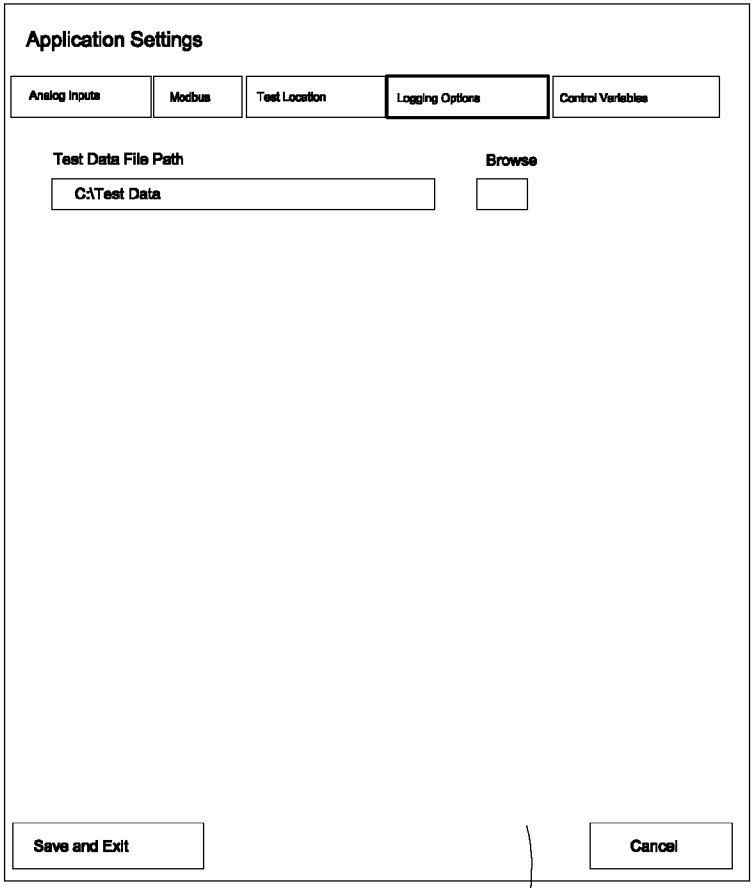
Figure 18A:
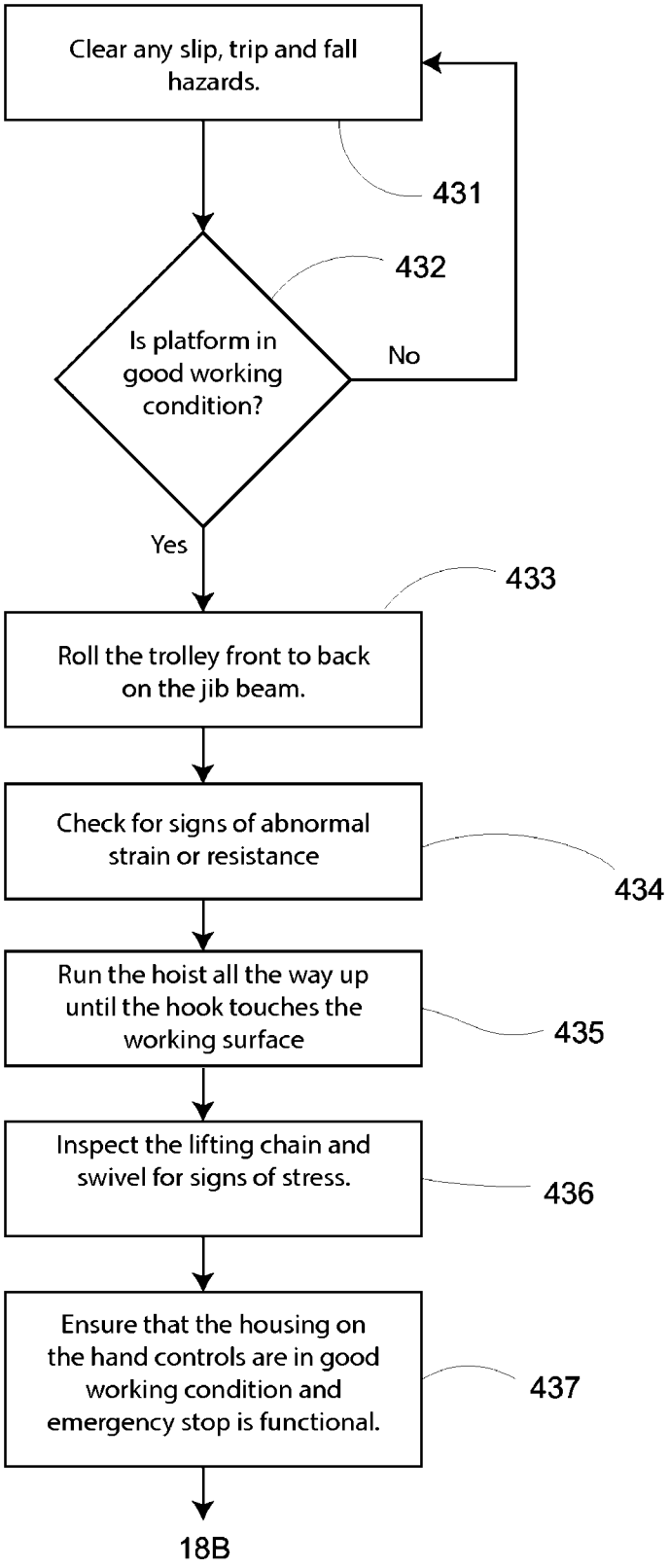
FIGS. 18A-18C detail steps in the training program and safety setup process in preparation of conducting a power tong test using the present invention.
Figure 18B:
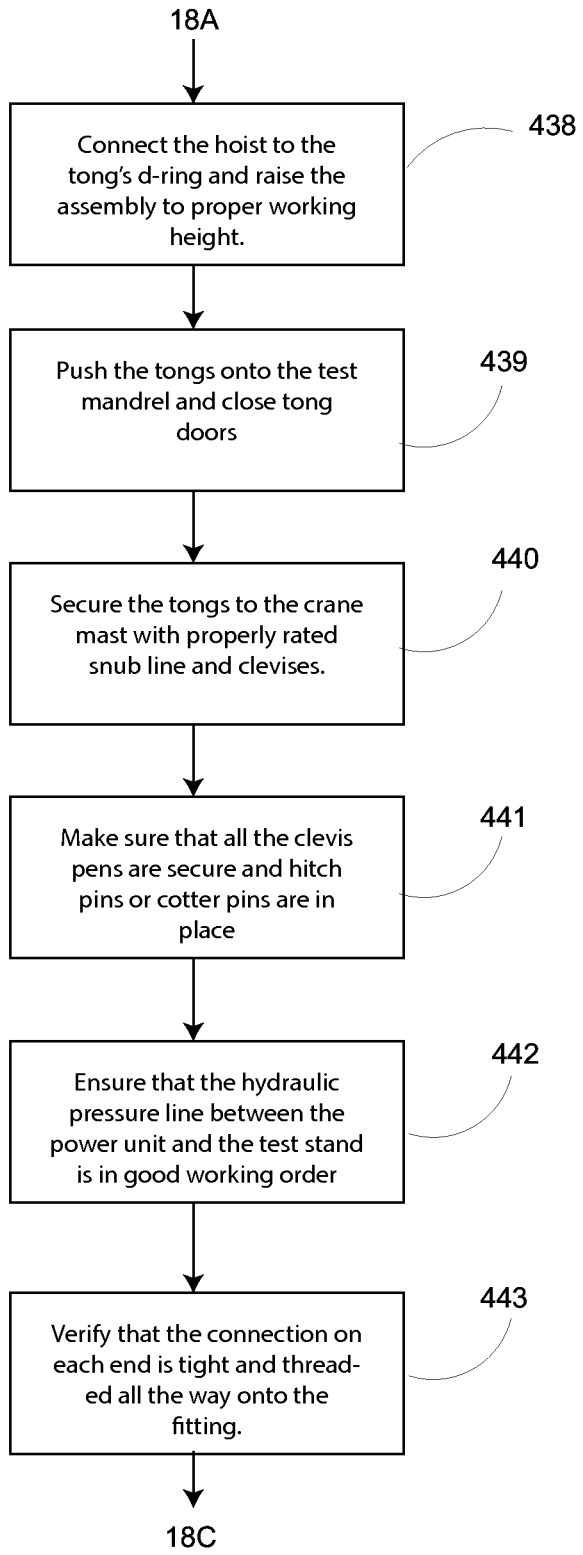
Figure 18C:
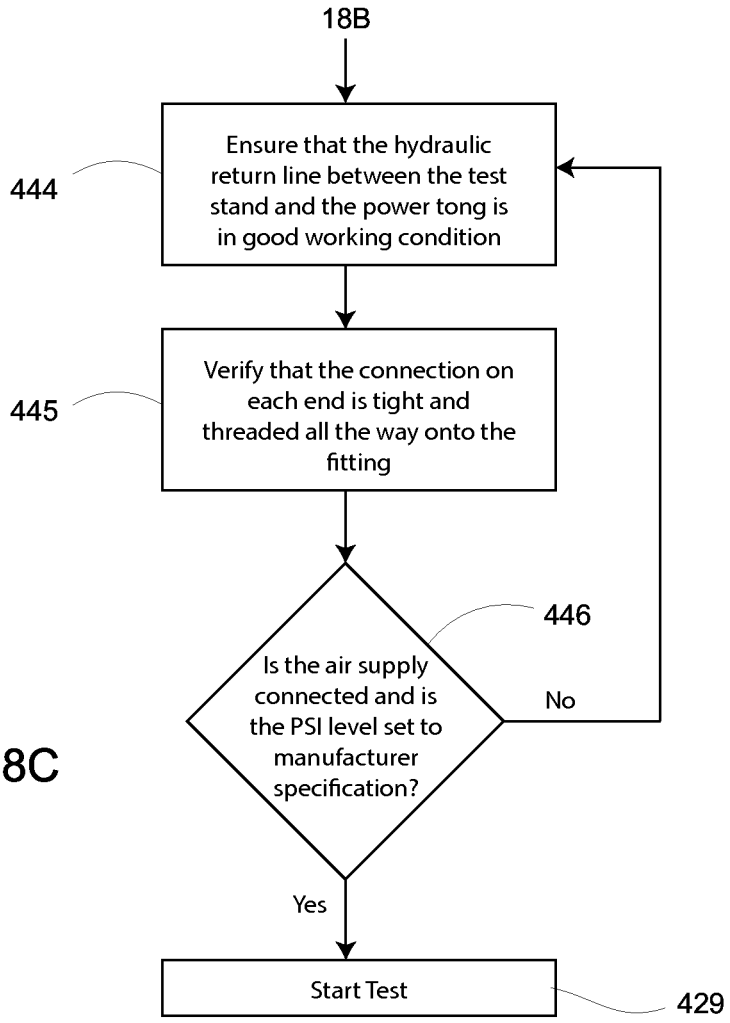

Turning now to FIGS. 14A-14C, control system 400 comprises controller stand 401 supporting cabinet 403 which contains within its interior 404 the electronics needed to analyze data from test stands 120, 220, 320. Cabinet 403 also includes touch screen 417 accessible from platform 11 whereby an operator (not shown) can proceed through setup procedures described below without having to open cabinet 403. Power supply 407 converts utility line voltage into direct current output for powering the other devices within cabinet 403.

Contained within cabinet 403, computer 415 provides means for entering software and data from outside sources for analyzing test stand 120, 220, 320 data. Computer 415 drives touch screen display 417 both to create displays thereon and to accept operator input. Computer 415 passes software instruction sets and operator input data to programmable logic controller (PLC) 413. PLC 413 also receives test stand 120, 220, 320 data from sensors 170, 180, 185, 190 through analog modules 411 which convert the sensor readings into digital equivalents for processing by PLC 413 according to the software provided by computer 415. PLC 413 then passes the results back to computer 415 for displaying on touch screen display 417.

Control system 400 also has the capability of transmitting test results to other, remote computers, such as drilling rig 10 operators and engineers (neither shown). Computer 415 passes such information in predetermined formats back to PLC 413 which includes wireless communication capabilities. PLC 413 connects to a wireless network in the vicinity of drill site 1 and accesses a computer network, whereon PLC 413 can dial up predetermined web sites, modems or other devices and transmit the information as instructed by computer 415. One having ordinary skill in the art will recognize that the network accessed by PLC 413 may be a local area network (LAN) probably operating just on drill site 1, a wide area network (WAN) coupling several sites such as drill site 1 together, certain proprietary networks such as 4G telephone and data networks, or a global network such as the internet, where any remote sites connected thereto, wherever situated, may be accessed by PLC 413. PLC 413 also is capable of sending its data by facsimile transmission over telephone networks, whether wireless or land-based. One having ordinary skill in the art will also recognize that such access need not be done via wireless communications, but could be tied directly by data communication cables without requiring wireless links, if such access is available.

Computer 415 preferably includes typical components such as a microprocessor, RAM memory, a hard drive for storage of data and software and input/output devices such as a keyboard, mouse and wireless and hard-wired connectivity devices. Also, preferably computer 415 is a ruggedized version for withstanding vibrations and rough handling on a drilling rig site. PLC 413 preferably includes both analog and digital inputs, a microprocessor and wireless and wired network connectivity. A suitable PLC 413 is model S7-1200 available from Siemens AG of Munich, Germany. A suitable touch screen display 417 is available as catalog number 6AV78600BH300AA0 also from Siemens AG of Munich, Germany. Suitable analog modules 411 are available as catalog number 6ES72141AG310XB0 also from Siemens AG of Munich, Germany.

Operational Procedures

In operation, an operator (not shown) of the present invention first will transport it to a testing site and set it up for operation. Such testing site preferably is drill site 10, and more preferably drilling rig 10 where power tongs 30, 50 may be tested with a minimum of disruption to routine operations of drilling rig 10. Alternately, tongs 30, 50 can be brought to a fixed testing site where they are tested and returned to drilling rig 10 if they pass certification. Still alternately, the invention could be included in tong manufacturing and repair installations.

Turning now to FIGS. 15A-17F, the operator powers up control system 400 using power button 407 (FIG. 14A) and is greeted by home screen 421 on display 417. A touch screen keyboard (not shown) may be provided when the operator is required to enter data such as the date, tong serial number or the like. Arrayed on home screen 421 are touch screen buttons which must be operated in sequence. This forces the operator to step through all safety procedures before conducting a test. Initially, the operator logs in 423 by entering his password 423A and, if the operator has administrative authority, may edit or create 426, 426A other permitted user logins. Alternately, the operator may proceed 424, 425 directly to data entry in preparation for conducting a test.

First, the operator also enters 425B specific data about the current power tong to be tested. Then, either the operator himself, or computer 415 automatically, selects 425A a set of power tong test criteria and standards from a tong library available either in computer 415's direct memory or hard drive, or through accessing remote tong libraries through network channels. Next, the operator inputs 450 settings regarding the modular bus 451, location data 453, data storage options 455 and analog control variables 457 such as air supply. One having ordinary skill in the art will recognize that numerous other data entry requirements could be included, such as the operator's name or the client's name (neither shown) without departing from the spirit and scope of the present invention.

Next, the operator must prepare test stand platform 101 for the planned test by stepping through a series of mandated safety checks. Referring now to FIGS. 18A-19B, the operator first checks the platform for hazards 431, 432 and operability 433, 434, 435, 436, 437 and corrects any problems found. Next, the operator connects hoist 115 to power tong 30 and lifts it into place adjacent mandrel 150. He then closes 439 jaws 36 onto mandrel mast 151 and assures they're locked properly. He next tethers 440 tong 30 to mast 111 using snub line 119 and double checks 441 connections. This is a particularly important safety check, because and un-tethered tong 30 will spin wildly around mandrel 150 unless it is restrained using snub line 119. Next, the operator investigates 442, 443, 444, 445 whether or not pneumatic and hydraulic hoses are properly connected and tight. Finally, he checks 446 the air pressure within the pneumatic system to assure it has reached the level necessary to operate calipers 160 and to run the test.

Figure 19A:
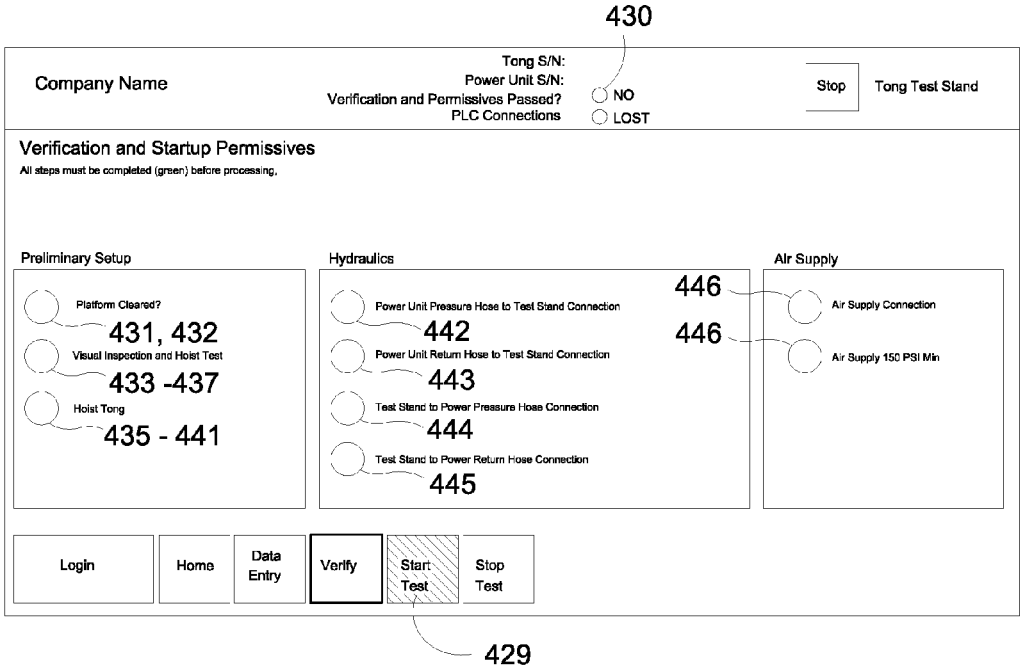
FIGS. 19A-19B show user interface screens for the testing itself, including before and after verification screens reflecting the steps shown in FIGS. 18A-18C.
Figure 19B:
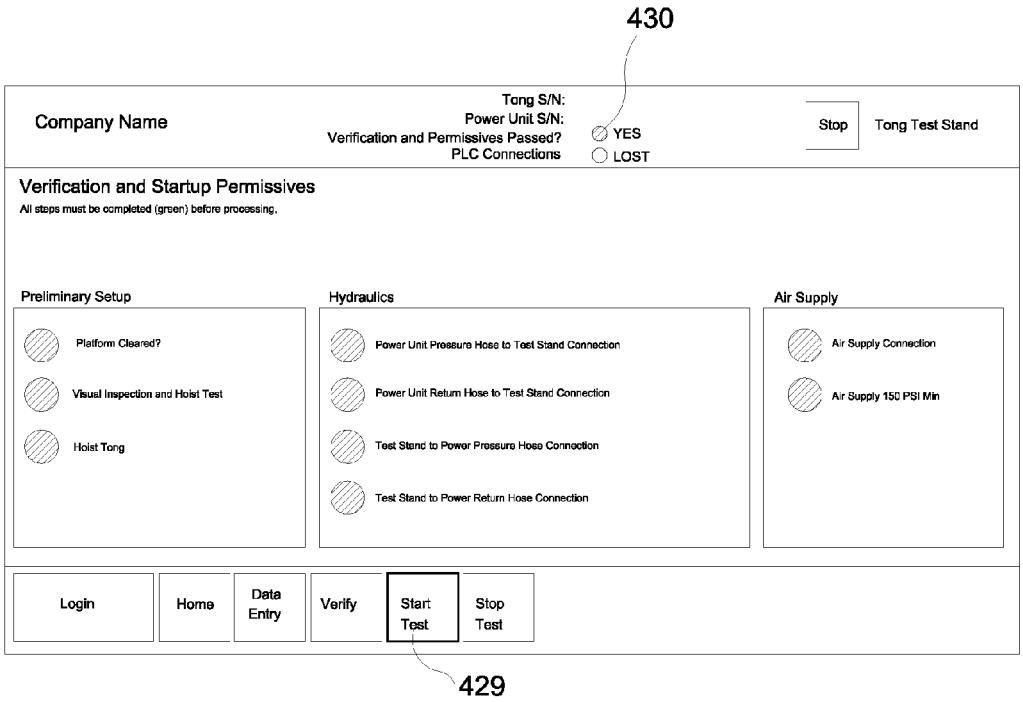

Referring specifically to FIGS. 19A-19B, touch screen display 417 shows a series of touch screen buttons that initially are blacked out, and safety procedure completion flag 430 remains dark and labeled "NO" (FIG. 19A). As the operator conducts each of the safety checks discussed above, he touches the appropriate touch screen button, thereby telling computer 415 that such check has been performed successfully and in the right order. At that juncture, computer 415 lights up that particular touch screen button, signifying that the check has been completed. Then, and not until then, the operator may proceed to the next safety check, conducting each in sequence until all touch screen buttons have been lighted and safety procedure completion flag 430 changes color and becomes labeled "YES" (FIG. 19B). Thus, the safety check procedure of FIGS. 19A-19B can be used as a training tool to teach new operators how to use the testing systems.

Figure 20A:
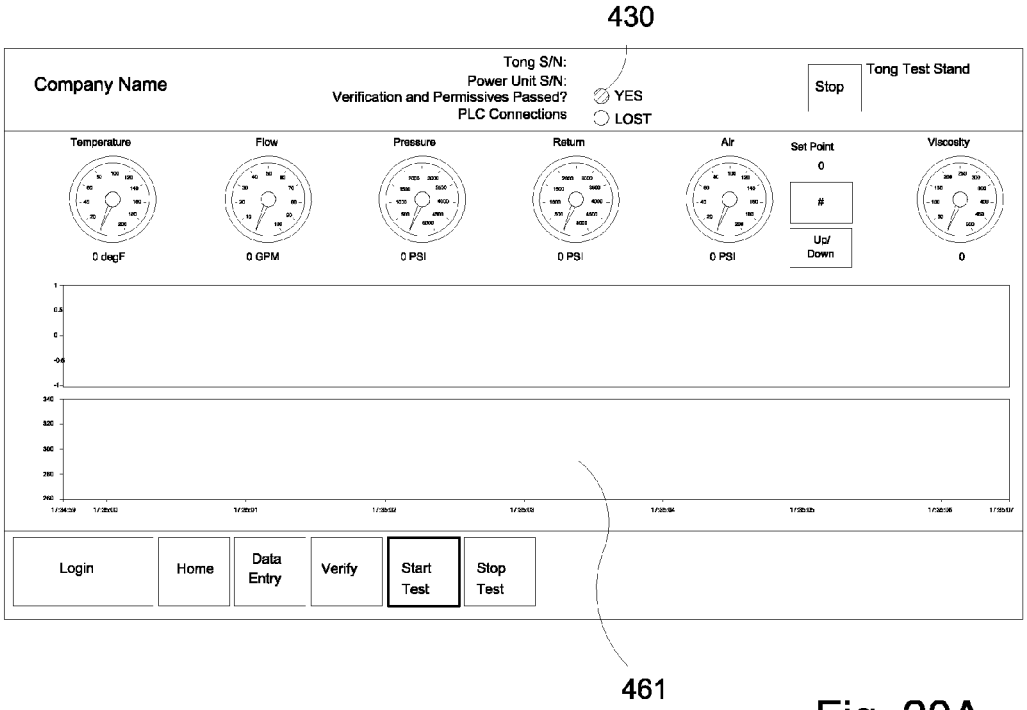
FIGS. 20A-20B show display screens provided on the control system monitor and in reporting format for a power tong test using the present invention.
Figure 20B:
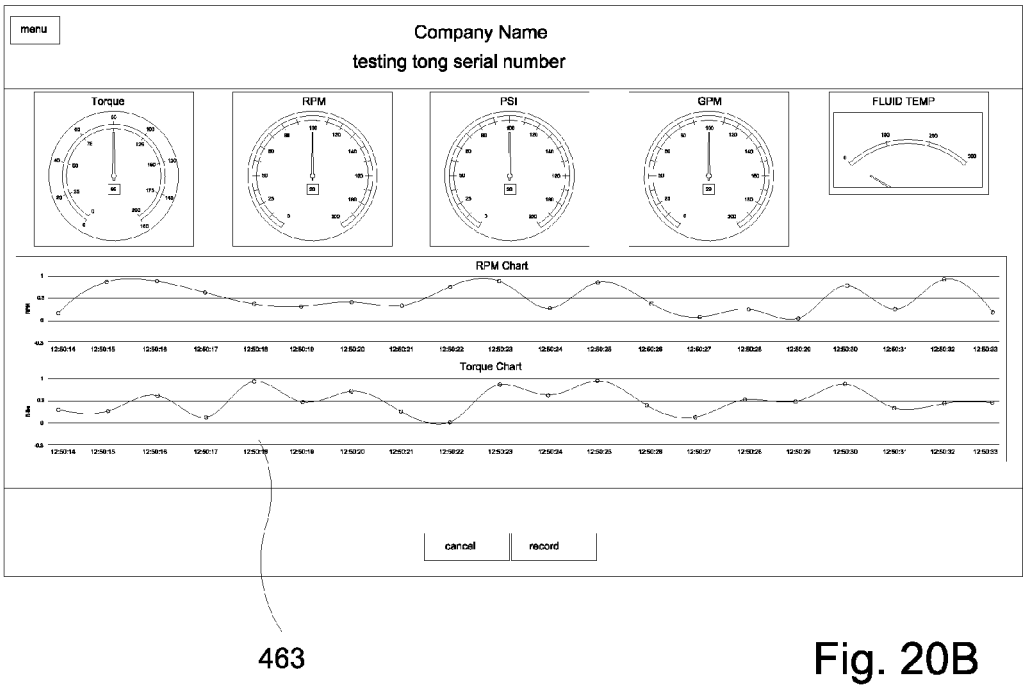

Referring now also to FIGS. 20A-20B, the power tong test then can begin. By touching now lighted "START TEST" touch screen button 429, the operator initiates testing tong 30. Jaws 36 begin to rotate, and when speed (RPM) sensor 180 informs PLC 413 that it is up to speed, pneumatic pressure is applied to calipers 160 to stop rotation of shaft 130 spinning under the impetus of tong 30. Eventually, calipers 160 stop all rotation of shaft 130, assuming tong 30 falls within the range of test stand 120, 220, 320. As the test is conducted, a display of test data 461, 463 may be generated in real time onto touch screen display 417. Alternately, data display 461, 463 may await completion of the entire tong 30 test, and reports of the results transmitted to locations as specified and discussed above.

While the invention has been particularly shown and described with reference to preferred and alternate embodiments, it will be understood by those skilled in the art that various changes in form and detail may be made therein without departing from the spirit and scope of the invention. For example, integrated tong 50 test system 300 has been depicted as having both inverted test stand 320 suspended from derrick 310 with a normal test stand 120, 220 in place beneath it and within derrick 310. This enable test system 300 to test both regular tongs 30 and integrated tongs 50 with the same device. Alternately, of course, test system could be set up with a simple, dummy mandrel (not shown) affixed to platform 301 for lower tong 52 to grasp for stabilizing integrated tong 50. Further, derrick 310 has been shown and discussed as only supporting test stand 320. It could, however, also include hoisting capabilities similar to beam 114 and winch block 115 to provide mobility for integrated tongs 50 as well.

We claim:

1. A testing system for power tongs, said power tongs having at least one set of clamping jaws adapted to surround and grasp an end of a well pipe, one of said at least one set of clamping jaws further having at least one drive motor for rotating said well pipe, the testing system comprising a test stand coupled to a platform and having a base having cylindrical walls extending normal to said platform and surrounding and defining a base chamber;

a slip tube having a proximate tube end disposed within the chamber and an opposite distal tube end;

a support flange coaxially affixed to the slip tube between the proximate and distal tube ends, said support flange supported by the base and having a chamber side and a mandrel side; and at least one caliper mounting plate affixed to the slip tube a spaced distance from the support flange;

a shaft journaled coaxially within the slip tube;

at least one annular rotor mounted concentric about the shaft adjacent at least one of said proximate and said distal tube ends;

a plurality of calipers mounted to each of said at least one caliper mounting plates and cooperating with one of said at least one rotor;

a mandrel extending coaxially from an end of the shaft opposite the platform;

control means for controlling said power tongs and said test stand; and measurement means for measuring test data generated by said test stand and communicating said test data to said control means.

2. The testing system of claim 1 and further comprising a first one of said at least one annular rotor mounted to said shaft adjacent said proximate tube end and enclosed within said chamber;

a second one of said at least one annular rotor mounted to said shaft adjacent said distal tube end;

a first one of said at least one caliper mounting plates disposed adjacent said first one of said at least one annular rotor and bearing at least one of said plurality of calipers cooperating with said first one of said at least one annular rotor;

a second one of said at least one caliper mounting plates disposed adjacent said second one of said at least one annular rotor and bearing at least one of said plurality of calipers cooperating with said second one of said at least one annular rotor.

3. The testing system of claim 2 and further comprising
a removable, cylindrical shield supported on said support flange and surrounding said second one of said at least one annular rotor and said at least one of said plurality of calipers.

4. The testing system of claim 1 and further comprising
power tongs supporting means mounted to said platform adjacent said test stand for supporting said power tongs during operation of said test stand.

5. The testing system of claim 4 wherein the power tongs supporting means comprises
a vertical mast supported by the platform;
a crane disposed upon and rotatable about said vertical mast and adapted to articulate between an operating position substantially vertically aligned with said test stand and a rest position;
lifting means slidably coupled along and supported by said crane for lifting said power tongs from said rest position and moving said power tongs into said operating position whereby said power tongs in said operating position engage said mandrel; and
tethering means for tethering said power tongs to said vertical mast.

6. The testing system of claim 4 wherein said power tongs supporting means comprises
a derrick resting on said platform, said derrick having
three substantially trapezoidal sides arrayed at substantially right angles to each other and coupled together to form a substantially rectangular derrick footing affixed to said platform;
at least one substantially rectangular derrick floor disposed on the derrick and elevated a spaced distance above said platform,
whereby said derrick is open on a fourth side for admitting said power tongs for testing using said test stand.

7. The testing system of claim 6 and further comprising
a beam coupled to said derrick and elevated above said platform; and
a block and tackle coupled to and supported by said beam, said block and tackle adapted to support said power tongs and to maneuver said power tongs through said open fourth side for engaging said power tongs with said test stand.

8. The testing system of claim 6 wherein
said power tongs comprise integrated power tongs having
a first power tongs drive jaw adapted to rotate well pipe; and
a second power tongs clamping jaw adapted to clamp onto well pipe and prevent it from rotating;
said test stand is supported by said at least one substantially rectangular derrick floor; and
said test stand mandrel extends downwardly from said test stand toward said platform;
whereby said power tong testing system is adapted to test said integrated power tongs.

9. The testing system of claim 6 wherein
said power tongs comprise integrated power tongs having
a first power tongs drive jaw adapted to rotate well pipe; and
a second power tongs clamping jaw adapted to clamp onto well pipe and prevent said well pipe from rotating; and
said testing system further comprises
a second test stand disposed beneath and supported by said at least one substantially rectangular derrick floor; and
said second test stand mandrel extends downwardly from said second test stand toward said platform and substantially aligned with said mandrel of said test stand;
whereby said first power tongs drive jaw engages said second test stand mandrel and said second power tongs clamping jaw engages said mandrel of said test stand during testing of said integrated power tongs.

10. The testing system of claim 6 wherein
said power tongs comprise integrated power tongs having
a first power tongs drive jaw adapted to rotate well pipe; and
a second power tongs clamping jaw adapted to clamp onto well pipe and prevent said well pipe from rotating; and
said testing system comprises
said test stand disposed on said platform beneath said at least one substantially rectangular derrick floor; and
an inverted second test stand disposed beneath and supported by said at least one substantially rectangular derrick floor, said inverted second test stand having a second test stand mandrel extending downwardly from said inverted second test stand toward said platform and substantially aligned with said mandrel of said first test stand;
whereby said first power tongs drive jaw engages said second test stand mandrel and said second power tongs clamping jaw engages said mandrel of said test stand during testing of said integrated power tongs.

11. The testing system of claim 1 wherein said measurement means comprises
torque sensing means for sensing torque test data generated by said power tongs during testing;
a speed sensor coupled to said slip tube and adapted to sense speed of rotation data of said shaft relative to said slip tube; and
fluid pressure sensing means for sensing air pressure test data in said calipers.

12. The testing system of claim 11 wherein said torque sensing means comprises
a first torque arm coupled to said base;
a second torque arm coupled to said support flange; and
a torque sensing load cell coupled between said first torque arm and said second torque arm.

13. The testing system of claim 12 wherein
said support flange surrounds and defines a plurality of slotted apertures arrayed around a perimeter of said support flange, said apertures communicating between said chamber side and said mandrel side and surrounding a like number of retention bolts adapted to articulate between a first slotted aperture end and a second slotted aperture end, whereby said support flange is slideably affixed to said base.

14. The power tong testing system of claim 1 wherein said control means comprises
a controller computer having
a microprocessor;
a plurality of inputs for receiving said test data from said test stand;
an input database for storing said test data;
a power tong library database containing standard test data criteria for a plurality of power tongs;
selecting means for selecting standard test data criteria for a select one of said plurality of power tongs in said power tong library database;
software operable on said controller computer for contrasting said test data to said standard test data criteria and generating test results; and
reporting means for reporting said test results to an operator of said testing system.

15. A testing system for power tongs, said power tongs having motor-driven clamping jaws adapted to surround and grasp a well pipe for rotating said pipe, the testing system comprising a substantially horizontal platform;

tong support means mounted to the platform;

a test stand coupled to the platform and having a base coupled to the platform and having cylindrical walls extending normal to said platform and surrounding and defining a base chamber; and a load bearing flange disposed on said cylindrical walls;

a cylindrical slip tube coaxial with the cylindrical walls and having a proximate tube end disposed within the chamber;

a distal tube end disposed outside the chamber;

a support flange coaxially affixed to the slip tube between the proximate and distal tube ends, said support flange slidably affixed to and supported by the load bearing flange; and at least one caliper mounting plate affixed to the slip tube a spaced distance from the support flange;

a shaft journaled coaxially within the slip tube and supported therein by bearings disposed in the proximate and distal tube ends, the shaft having at least one annular rotor mounted concentric about the shaft adjacent at least one of said proximate and said distal tube ends; and a power tong-engaging mandrel extending coaxial with and from an end of the shaft opposite the platform;

a plurality of calipers mounted to each of said at least one caliper mounting plate and cooperating with one of said at least one rotor;

control means coupled to said platform for controlling said power tongs and said test stand; and data sensing means coupled between said test stand and said control means for sensing test data and communicating said test data to said control means.

16. An improved method of testing power tongs for the drilling industry, said power tongs having at least one set of clamping jaws adapted to surround and grasp an end of a well pipe, one of said at least one set of clamping jaws further having at least one drive motor for rotating said well pipe, the improved method comprising providing a power tong testing system having a test stand having a mandrel adapted to engage said at least one set of clamping jaws;

a shaft coupled to said mandrel, said shaft having at least one annular rotor coupled to said shaft and adapted to rotate with said mandrel;

a slip tube surrounding and coaxial with said shaft and having at least one caliper mounting plate;

a plurality of calipers mounted to said at least one caliper mounting plate, each of said plurality of calipers adapted to engage one of said at least one annular rotor; and test data sensing means for sensing test data; and controller means for controlling said power tongs and said test stand and for receiving and analyzing said test data;

providing power tongs maneuvering means for maneuvering said power tongs; then maneuvering said power tongs into a testing position engaging said mandrel of said test stand; then operating said controller means to test said power tongs.

17. The improved method of claim 16 wherein said power tongs maneuvering means comprises a derrick coupled to said test stand and having at least three derrick sides extending between a derrick footing and a derrick top and defining a derrick interior containing said test stand;

a beam coupled to said derrick top; and a block and tackle coupled to and supported by said beam, said block and tackle adapted to support said power tongs and to maneuver said power tongs into said derrick interior to cause said power tongs to engage said test stand for testing said power tongs.

18. The improved method of claim 16 wherein said operating step further comprises entering into said controller means identification data identifying a select power tongs to be tested;

using the controller means to select power tongs standard test data criteria from a power tongs library database;

conducting said test of said power tongs and receiving said test data; then contrasting said test data to said standard test data criteria to generate a test results; then reporting said test results.

19. The improved method of claim 18 and further comprising the steps of before the conducting step, performing a plurality of safety checks by a. reading a safety check instruction from said controller means; then b. carrying out said safety check instruction; then c. noting on said controller means that said safety check instruction has been successfully carried out; then repeating steps (a) through (c) inclusive.

* * * * *